US010407645B2

(12) United States Patent
Ebashi et al.

(10) Patent No.: US 10,407,645 B2
(45) Date of Patent: Sep. 10, 2019

(54) COATED [ALPHA]-SULFOFATTY ACID ALKYL ESTER SALT PARTICLE GROUP, METHOD FOR PRODUCING SAME, AND POWDER DETERGENT

(71) Applicant: LION CORPORATION, Tokyo (JP)

(72) Inventors: Yoichi Ebashi, Tokyo (JP); Yohei Nogami, Tokyo (JP); Takashi Kobayashi, Tokyo (JP); Kensuke Itakura, Tokyo (JP); Kenji Morimura, Tokyo (JP); Masashi Hara, Tokyo (JP); Hideaki Watanabe, Tokyo (JP)

(73) Assignee: Lion Corporation, Tokyo (JP)

( * ) Notice: Subject to any disclaimer, the term of this patent is extended or adjusted under 35 U.S.C. 154(b) by 0 days.

(21) Appl. No.: 15/515,264

(22) PCT Filed: Oct. 1, 2015

(86) PCT No.: PCT/JP2015/077980
§ 371 (c)(1),
(2) Date: Mar. 29, 2017

(87) PCT Pub. No.: WO2016/052713
PCT Pub. Date: Apr. 7, 2016

(65) Prior Publication Data

US 2017/0218302 A1 Aug. 3, 2017

(30) Foreign Application Priority Data

Oct. 1, 2014 (JP) ..... 2014-203126

(51) Int. Cl.

| | |
|---|---|
| ***C11D 1/28*** | (2006.01) |
| ***C11D 17/06*** | (2006.01) |
| ***C11D 3/12*** | (2006.01) |
| ***C11D 17/00*** | (2006.01) |

(52) U.S. Cl.
CPC ..... *C11D 1/28* (2013.01); *C11D 3/128* (2013.01); *C11D 17/0039* (2013.01); *C11D 17/06* (2013.01)

(58) Field of Classification Search
None
See application file for complete search history.

(56) References Cited

U.S. PATENT DOCUMENTS

| | | | | |
|---|---|---|---|---|
| 6,057,280 | A * | 5/2000 | Huish | C11D 1/28 446/447 |
| 6,288,020 | B1 * | 9/2001 | Huish | C11D 1/28 446/447 |
| 6,780,830 | B1 * | 8/2004 | Huish | C11D 1/28 510/127 |
| 2006/0160717 | A1 * | 7/2006 | Itakura | C11D 1/28 510/447 |

FOREIGN PATENT DOCUMENTS

| | | | |
|---|---|---|---|
| CN | 1371361 | A | 9/2002 |
| CN | 102994257 | A | 3/2013 |
| CN | 102994258 | A | 3/2013 |
| JP | 2011116807 | A | 6/2011 |
| JP | 2012126840 | A | 7/2012 |
| WO | 2012043699 | A1 | 4/2012 |

OTHER PUBLICATIONS

Japanese Patent Office, "International Search Report" in connection with related International Application No. PCT/JP2015/077980, dated Dec. 22, 2015, 2 pages.
State Intellectual Property Office of the People's Republic of China, "Search Report", including partial translation, in connection with related Chinese Patent Application No. 201580053256.1, dated Oct. 12, 2018, 7 pages.
Colombian Patent Office, "Office Action" in connection with related Colombian Patent Application No. NC2017/0003121, dated Aug. 17, 2018, 15 pgs.

* cited by examiner

*Primary Examiner* — Katie L. Hammer
(74) *Attorney, Agent, or Firm* — Kolisch Hartwell, P.C.

(57) ABSTRACT

A coated α-sulfofatty acid alkyl ester salt particle group containing α-sulfofatty acid alkyl ester salt particles (A) and a zeolite particle group-containing coating component (B) with which the particles (A) are coated, in which the zeolite particle group is a zeolite particle group (b1) having a mean particle size of equal to or greater than 0.8 μm and less than 3.8 μm.

6 Claims, No Drawings

COATED [ALPHA]-SULFOFATTY ACID ALKYL ESTER SALT PARTICLE GROUP, METHOD FOR PRODUCING SAME, AND POWDER DETERGENT

TECHNICAL FIELD

The present invention relates to a coated α-sulfofatty acid alkyl ester salt particle group, a method for producing the same, and a powder detergent.

Priority is claimed on Japanese Patent Application No. 2014-203126, filed on Oct. 1, 2014, the content of which is incorporated herein by reference.

BACKGROUND ART

In the related art, an α-sulfofatty acid alkyl ester salt (α-SF salt) is widely used as a surfactant formulated with a powder detergent for clothes.

In the recent years, the α-SF salt has been manufactured as a group of particles (α-SF salt particle group) containing the α-SF salt at a high concentration, and by performing dry blending of the particle group and other detergent components, a powder detergent has been manufactured. Therefore, until being used by being blended with the detergent components after manufacturing, the α-SF salt particle group is transported or stored for a long period of time in some cases.

If the α-SF salt particle group is weighted down during transportation or stored in a high-temperature environment, unfortunately, the particles are aggregated with each other and solidified. Particularly, if the α-SF salt particle group contains a large amount of fine powder, the solidification more easily occurs.

Regarding the aforementioned problems, PTL 1 discloses that, by coating the α-SF salt particles with a coating agent and a liquid raw material, the solidification of the particle group containing the particles can be inhibited.

CITATION LIST

Patent Literature

[PTL 1] Japanese Unexamined Patent Application, First Publication No. 2011-116807

SUMMARY OF INVENTION

Technical Problem

However, the technique of PTL 1 still needs to be ameliorated in terms of the solidification inhibitory properties. Particularly, in a case where the α-SF salt particle group contains a large amount of fine powder, the solidification inhibitory properties are insufficient.

The present invention has been made in consideration of the above circumstances, and an object thereof is to provide a coated α-sulfofatty acid alkyl ester salt particle group having excellent solidification inhibitory properties.

Solution to Problem

As a result of conducting intensive investigation, the inventors of the present invention found that a coated α-sulfofatty acid alkyl ester salt particle group describe below makes it possible to achieve the aforementioned object.

That is, the present invention has the following constitution.

[1] A coated α-sulfofatty acid alkyl ester salt particle group containing an α-sulfofatty acid alkyl ester salt particles (A), and a zeolite particle group-containing coating component (B) with which the particles (A) are coated, in which the zeolite particle group is a zeolite particle group (b1) having a mean particle size of equal to or greater than 0.8 μm and less than 3.8 μm.

[2] The coated α-sulfofatty acid alkyl ester salt particle group described in [1], in which a content of the fatty acid alkyl ester in the particles (A) is 0.9% to 4.0% by mass, and a content of particles having a particle size of equal to or less than 355 μm in the coated α-sulfofatty acid alkyl ester salt particle group is equal to or greater than 20% by mass.

[3] The coated α-sulfofatty acid alkyl ester salt particle group described in [1] or [2], in which when the particles (A) are thermally analyzed using a differential scanning calorimeter, an observed heat absorption peak area S1 at a temperature of 50° C. to 130° C. is less than 50% of a heat absorption peak area S2 at a temperature of 0° C. to 130° C.

[4] A powder detergent containing the coated α-sulfofatty acid alkyl ester salt particle group described in any one of [1] to [3].

[5] A method for manufacturing the coated α-sulfofatty acid alkyl ester salt particle group described in any one of [1] to [3], including a step of coating the α-sulfofatty acid alkyl ester salt particles (A) with the zeolite particle group-containing coating component (B), in which the zeolite particle group is the zeolite particle group (b1) having a mean particle size of equal to or greater than 0.8 μm and less than 3.8 μm.

[6] The method for manufacturing the coated α-sulfofatty acid alkyl ester salt particle group described in [5], in which the content of the particles having a particle size of equal to or less than 355 μm in the particle group constituted with the particles (A) is equal to or greater than 20% by mass, and the content of the fatty acid alkyl ester in the particles (A) is 0.9% to 4.0% by mass.

[7] The method for manufacturing the coated α-sulfofatty acid alkyl ester salt particle group described in [5] or [6], further including a particle (A) manufacturing step of manufacturing the particles (A), in which the particle (A) manufacturing step includes a sulfonation treatment for causing sulfonation by bringing the fatty acid alkyl ester into contact with a sulfonation gas, and a molar ratio of the sulfonation gas to the fatty acid alkyl ester in the sulfonation treatment is 1.05 to 1.13.

[8] A coated α-sulfofatty acid alkyl ester salt particle group containing α-sulfofatty acid alkyl ester salt particles (A) and a zeolite particle group-containing coating component (B) with which the particles (A) are coated, in which the coating component (B) contains at least one kind (b2) selected from a fatty acid alkyl ester, a higher alcohol having 8 to 22 carbon atoms, and polyethylene glycol.

[9] The coated α-sulfofatty acid alkyl ester salt particle group described in [8], in which the coating component (B) further contains a zeolite particle group (b1) having a mean particle size of equal to or greater than 0.8 μm and less than 3.8 μm.

[10] The coated α-sulfofatty acid alkyl ester salt particle group described in [8] or [9], in which when the particles (A) are thermally analyzed using a differential scanning calorimeter, an observed heat absorption peak area S1 at a temperature of 50° C. to 130° C. is less than 50% of a heat absorption peak area S2 at a temperature of 0° C. to 130° C.

[11] A powder detergent containing the coated α-sulfofatty acid alkyl ester salt particle group described in any one of [8] to [10].

[12] A method for manufacturing the coated α-sulfofatty acid alkyl ester salt particle group described in any one of [8] to [10], including a step of coating the α-sulfofatty acid alkyl ester salt particles (A) with the zeolite particle group-containing coating component (B), in which the coating component (B) contains at least one kind (b2) selected from a fatty acid alkyl ester, a higher alcohol having 8 to 22 carbon atoms, and polyethylene glycol.

[13] The method for manufacturing the coated α-sulfofatty acid alkyl ester salt particle group described in [11] or [12], further including a particle (A) manufacturing step of manufacturing the particles (A), in which the particle (A) manufacturing step includes a sulfonation treatment for causing sulfonation by bringing the fatty acid alkyl ester into contact with a sulfonation gas, and a molar ratio of the sulfonation gas to the fatty acid alkyl ester in the sulfonation treatment is 1.05 to 1.13.

[14] α-sulfofatty acid alkyl ester salt-containing powder containing α-sulfofatty acid alkyl ester salt particles (A), in which a content of particles having a particle size of equal to or less than 355 μm is equal to or greater than 20% by mass, and a content of the fatty acid alkyl ester in the particles (A) is 0.9% to 4.0% by mass.

[15] The α-sulfofatty acid alkyl ester salt-containing powder described in [14], in which the particles (A) are coated with a zeolite particle group-containing coating component (B).

[16] The α-sulfofatty acid alkyl ester salt-containing powder described in [15], in which the zeolite particle group contains a zeolite particle group (b3) having a mean particle size of equal to or greater than 3.8 μm and equal to or less than 5.0 μm.

[17] The α-sulfofatty acid alkyl ester salt-containing powder described in any one of [14] to [16], in which when the particles (A) are thermally analyzed using a differential scanning calorimeter, an observed heat absorption peak area S1 at a temperature of 50° C. to 130° C. is less than 50% of a heat absorption peak area S2 at a temperature of 0° C. to 130° C.

[18] A powder detergent containing the α-sulfofatty acid alkyl ester salt-containing powder described in any one of [14] to [17].

[19] A method for manufacturing the α-sulfofatty acid alkyl ester salt-containing powder described in any one of [14] to [17], including a particle (A) manufacturing step of manufacturing α-sulfofatty acid alkyl ester salt particles (A), in which the particle (A) manufacturing step includes a sulfonation treatment for causing sulfonation by bringing the fatty acid alkyl ester into contact with a sulfonation gas, and a molar ratio of the sulfonation gas to the fatty acid alkyl ester in the sulfonation treatment is 1.05 to 1.13.

[20] The method for manufacturing the α-sulfofatty acid alkyl ester salt-containing powder described in [19], further including a step of coating the particles (A) with a zeolite particle group-containing coating component (B).

[21] The method for manufacturing the α-sulfofatty acid alkyl ester salt-containing powder described in [20], in which the zeolite particle group contains a zeolite particle group (b3) having a mean particle size of equal to or greater than 3.8 μm and equal to or less than 5.0 μm.

Advantageous Effects of Invention

The coated α-sulfofatty acid alkyl ester salt particle group of the present invention has excellent solidification inhibitory properties.

DESCRIPTION OF EMBODIMENTS

<Coated α-Sulfofatty Acid Alkyl Ester Salt Particle Group>

The coated α-sulfofatty acid alkyl ester salt particle group (hereinafter, referred to as a "coated α-SF salt particle group" as well) of the present invention is a group of coated α-sulfofatty acid alkyl ester salt particles in which α-sulfofatty acid alkyl ester salt particles (A) are coated with a zeolite particle group-containing coating component (B).

(First Embodiment)

In a coated α-SF salt particle group according to a first embodiment of the present invention, α-sulfofatty acid alkyl ester salt particles (A) are coated with a coating component (B) containing a zeolite particle group (b1) having a mean particle size of equal to or greater than 0.8 μm and less than 3.8 μm.

The mean particle size of the coated α-SF salt particle group is preferably 250 μm to 3 mm, and more preferably 350 μm to 1 mm. If the mean particle size of the particle group is equal to or greater than 250 μm, solidification is more easily inhibited. If the mean particle size of the particle group is equal to or less than 3 mm, when the coated α-SF salt particle group is formulated with a powder detergent or the like, an extremely big difference does not easily occur between the coated α-SF salt particle group and other components, and hence the problem of separation or the like can be easily prevented.

The mean particle size of the coated α-SF salt particle group of the present invention is a value measured as below.

By using 9 stages of sieves with apertures having sizes of 1,700 μm, 1,400 μm, 1,180 μm, 1,000 μm, 710 μm, 500 μm, 355 μm, 250 μm, and 150 μm, and a saucer, a particle classification operation is performed. For the classification operation, the sieves are piled up on the saucer in order from a sieve with small apertures to a sieve with large apertures. The particles are put into the sieves from above the 1,700 μm sieve in the uppermost portion in an amount of 100 g each time, and the sieve is capped. The sieves are mounted on a Ro-Tap type sieve shaker (manufactured by DALTON CORPORATION, tapping: 125 times/min, rolling: 250 times/min) and shaken for 3.5 minutes, and then the samples remaining on each sieve and the saucer are collected for each sieve aperture. By repeating the aforementioned operation, classified samples are obtained which have particles sizes of greater than 1,400 μm and equal to or less than 1,700 μm (1,400 μm. on), greater than 1,180 μm and equal to or less than 1,400 μm (1,180 μm. on), greater than 1,000 μm and equal to or less than 1,180 μm (1,000 μm. on), greater than 710 μm and equal to or less than 1,000 μm (710 μm. on), greater than 500 μm and equal to or less than 710 μm (500 μm. on), greater than 355 μm and equal to or less than 500 μm (355 μm. on), greater than 250 μm and equal to or less than 355 μm (250 μm. on), greater than 150 μm and equal to or less than 250 μm (150 μm. on), and the size of particles on the saucer and equal to or less than 150 μm (150 μm. pass), and a mass frequency (%) is calculated.

The aperture of the sieve is denoted by X, and the sum of mass frequencies (%) of the classified samples collected onto the sieves having the aperture X and the aperture greater than X is denoted by Y.

The slope of a least square approximation line at the time of plotting log {log(100/Y)} with respect to log X is denoted by a, and an intercept is denoted by y (log is a common logarithm). Here, the points at which Y is equal to or less than 5% and equal to or greater than 95% are excluded from the aforementioned plot.

By using a and y described above, a mean particle size can be determined by the following equation.

Mean particle size (mass 50% diameter)$=10^{((-0.521-y)/a)}$

The bulk density of the coated α-SF salt particle group is preferably 0.55 to 0.75 kg/L, and more preferably 0.60 to 0.70 kg/L. If the bulk density of the particle group is within the above preferred range, the solubility can be easily improved, and space can be saved at the time of storage. The bulk density is measured based on JIS K3362:1998.

<Component (A)>

The component (A) is α-sulfofatty acid alkyl ester salt particles.

The component (A) is particles containing an α-sulfofatty acid alkyl ester salt (α-SF salt) at a high concentration. The particles contain the α-SF salt in an amount of equal to or greater than 60% by mass.

The content of the α-SF salt in the component (A) is preferably equal to or greater than 70% by mass, and more preferably equal to or greater than 80% by mass.

The α-SF salt contained in the component (A) is represented by the following Formula (1).

$$R^1\text{—}CH(SO_3M)\text{-}COOR^2 \quad (1)$$

[In Formula (1), $R^1$ is a linear or branched alkyl group having 6 to 20 carbon atoms or a linear or branched alkenyl group having 6 to 20 carbon atoms, $R^2$ is an alkyl group having 1 to 6 carbon atoms, and M is a counterion.]

The number of carbon atoms of $R^1$ is preferably 8 to 18, and more preferably 12 to 16.

The number of carbon atoms of $R^2$ is preferably 1 to 3. Examples of $R^2$ include a methyl group, an ethyl group, a propyl group, and an isopropyl group. $R^2$ is preferably a methyl group, an ethyl group, or a propyl group because these further improve detergency.

Examples of M include an alkali metal slat such as sodium or potassium, an amine salt such as monoethanolamine, diethanolamine, or triethanolamine, an ammonium salt, and the like. Among these, an alkali metal salt is preferable, and a sodium salt or a potassium salt is more preferable.

It is preferable that, in the α-SF salt, $R^1$ consists of 14 carbon atoms and 16 carbon atoms at a mass ratio of 40:60 to 100:0. Furthermore, the α-SF salt is preferably an α-sulfofatty acid methyl ester salt (MES salt) in which $R^2$ is a methyl group.

One kind of the α-SF salt may be used singly, or two or more kinds thereof may be used in combination.

The component (A) may contain, in addition to the α-SF salt, a by-product such as an α-sulfofatty acid metal salt or an alkyl sulfate metal salt or moisture that is adjunctively produced in the synthesis process of the α-SF salt. Generally, the component (A) contains the α-SF salt in an amount of 60% to 98% by mass, an α-sulfofatty acid metal salt in an amount of 1% to 10% by mass, and an alkyl sulfate metal salt in an amount of 1% to 10% by mass.

The amount of moisture in the component (A) is preferably equal to or less than 10% by mass, and more preferably equal to or less than 5% by mass. If the amount of moisture in the component (A) is equal to or less than 10% by mass, the stickiness of the component (A) at a low temperature can be easily suppressed, and the storage stability at a low temperature can be easily improved.

The component (A) preferably contains a fatty acid alkyl ester. Examples of the fatty acid alkyl ester include a compound represented by the following Formula (2).

$$R^3COOR^4 \quad (2)$$

[In Formula (2), $R^3$ is a linear or branched alkyl group having 7 to 21 carbon atoms or a linear or branched alkenyl group having 7 to 21 carbon atoms, and $R^4$ is an alkyl group having 1 to 6 carbon atoms.]

The number of carbon atoms of $R^3$ is preferably 9 to 19, and more preferably 13 to 17.

The number of carbon atoms of $R^4$ is preferably 1 to 3. Examples of $R^4$ include a methyl group, an ethyl group, a propyl group, and an isopropyl group. The fatty acid alkyl ester is particularly preferably a fatty acid methyl ester (ME) in which $R^4$ is a methyl group.

It is preferable that, in the fatty acid alkyl ester, $R^3$ consists of 15 carbon atoms and 17 carbon atoms at a mass ratio of 40:60 to 100:0.

One kind of the fatty acid alkyl ester may be used singly, or two or more kinds thereof may be used in combination.

The aforementioned fatty acid alkyl ester may be the same as or different from the fatty acid alkyl ester which is a raw material at the time of manufacturing the α-SF salt.

The content of the fatty acid alkyl ester in the component (A) is, with respect to the total mass of the component (A), preferably equal to or greater than 0.9% by mass, more preferably equal to or greater than 1.0% by mass, and even more preferably equal to or greater than 1.5% by mass. If the content of the fatty acid alkyl ester in the component (A) is the preferred amount described above, a coated α-SF salt particle group having excellent solidification inhibitory properties is easily obtained.

The content of the fatty acid alkyl ester in the component (A) is, with respect to the total mass of the component (A), preferably equal to or less than 4.0% by mass, more preferably equal to or less than 3.5% by mass, and even more preferably equal to or less than 2.5% by mass. If the content of the fatty acid alkyl ester in the component (A) is the preferred amount described above, it is easy to obtain a coated α-SF salt particle group with a high content of an α-SF salt which is an active component.

The content of the fatty acid alkyl ester in the component (A) is, with respect to the total mass of the component (A), preferably 0.9% to 4.0% by mass, more preferably 1.0% to 3.5% by mass, even more preferably 1.5% to 3.5% by mass, and particularly preferably 1.5% to 2.5% by mass. If the content of the fatty acid alkyl ester in the component (A) is within the preferred range described above, it is easy to obtain a coated α-SF salt particle group having excellent solidification inhibitory properties with a high content of an active component.

Regarding the aforementioned fatty acid alkyl ester, for example, at the time of manufacturing the aforementioned α-SF salt, a reaction molar ratio between the fatty acid alkyl ester as a raw material and a sulfonation gas may be adjusted such that the unreacted fatty acid alkyl ester is contained in the component (A) within the aforementioned range. Alternatively, after the α-SF salt is manufactured, the fatty acid alkyl ester may be added such that the fatty acid alkyl ester is contained in the component (A) within the aforementioned range. It is preferable to use the former method because then the number of manufacturing steps is reduced, and the productivity becomes excellent.

The mean particle size of the group of the component (A) is preferably 250 to 3,000 μm, and more preferably 350 to 1,000 μm. If the mean particle size of the group of the component (A) is equal to or greater than 250 μm, the solidification of the coated α-SF salt particle group of the present invention is more easily inhibited. If the mean particle size of the group of the component (A) is equal to or less than 3,000 μm, when the coated α-SF salt particle group of the present invention is formulated with a powder detergent or the like, an extremely big difference does not easily occur between the coated α-SF salt particle group and other components, and hence the problem of separation or the like can be easily prevented.

The mean particle size of the group of the component (A) is a value determined by the same method as used for determining the mean particle size of the coated α-SF salt particle group.

The group of the component (A) may contain particles having a particle size of equal to or less than 355 μm (hereinafter, referred to as "fine powder" as well), in an amount of equal to or greater than 20% by mass with respect to the total mass of the group of the component (A). If the content of the fine powder in the group of the component (A) is within the above range, in a method for manufacturing the component (A) that will be described later, the classification operation can be skipped, and the productivity is improved. In view of further improving the productivity, the content of the fine powder of the group of the component (A) is preferably equal to or greater than 30% by mass with respect to the total mass of the group of the component (A). The content of the fine powder of the group of the component (A), with respect to the total mass of the group of the component (A), may be 100% by mass, preferably equal to or less than 70% by mass, more preferably equal to or less than 60% by mass, and even more preferably equal to or less than 50% by mass. If the content of the fine powder in the group of the component (A) is equal to or less than the aforementioned upper limit, it is easy to obtain a coated α-SF salt particle group having excellent solidification inhibitory properties.

The content of the fine powder in the group of the component (A) is, with respect to the total mass of the group of the component (A), preferably 20% to 70% by mass, more preferably 30% to 70% by mass, even more preferably 30% to 60% by mass, and particularly preferably 30% to 50% by mass. If the content of the fine powder in the group of the component (A) is within the aforementioned preferred range, it is easy to obtain a coated α-SF salt particle group having excellent solidification inhibitory properties, and the productivity is improved.

The content of particles having a particle size of greater than 250 μm and equal to or less than 355 μm in the aforementioned fine powder is preferably 20% to 50% by mass with respect to the total mass of the fine powder. The content of particles having a particle size of greater than 150 μm and equal to or less than 250 μm in the aforementioned fine powder is preferably 20% to 50% by mass with respect to the total mass of the fine powder. The content of particles having a particle size of equal to or less than 150 μm in the aforementioned fine powder is 15% to 45% by mass with respect to the total mass of the fine powder.

The particle size distribution of the group of the component (A) is not particularly limited. For example, the group of the component (A) has a particle size distribution in which the content of particles having a particle size of greater than 1,180 μm is 0% to 5% by mass with respect to the total mass of the group of the component (A), the content of particles having a particle size of greater than 710 μm and equal to or less than 1,180 μm is 15% to 35% by mass with respect to the total mass of the group of the component (A), the content of particles having a particle size of greater than 355 μm and equal to or less than 710 μm is 15% to 55% by mass with respect to the total mass of the group of the component (A), and the content of fine powder is 20% to 70% by mass with respect to the total mass of the group of the component (A).

As the component (A), the particles are preferable in which the content of the fatty acid alkyl ester in the component (A) is 0.9% to 4.0% by mass, and the content of fine powder in the group of the component (A) is equal to or greater than 20% by mass. If such a component (A) is used, the productivity becomes excellent, and it is easy to obtain a coated α-SF salt particle group having excellent solidification inhibitory properties.

The component (A) can be manufactured by a known method. Alternatively, a commercially available product can be used as the component (A).

[Method for Manufacturing Component (A)]

Examples of the method for manufacturing the component (A) (particles (A)) include a method having a step of preparing a α-SF salt-containing paste (paste preparing step), a step of preparing flakes from the paste (flaking step), a step of preparing noodles from the flakes (noodle preparing step), a step of preparing pellets from the noodles (pelletizing step), and a step of obtaining particles by grinding the flakes, the noodles, or the pellets (grinding step).

The (noodle preparing step) and the (pelletizing step) are optional steps and may be skipped. Furthermore, after the (grinding step), a step of classifying the group of α-SF salt particles (classifying step) may be performed. In addition, after the (flaking step), the (noodle preparing step), or the (pelletizing step), a step of maturing the flakes, the noodles, or the pellets (maturing step) may be performed.

[Paste Preparing Step]

In the paste preparing step, for example, by performing a sulfonation treatment for causing sulfonation by bringing the fatty acid alkyl ester as a raw material into contact with a sulfonation gas ($SO_3$) or the like, an esterification treatment for causing esterification by adding a lower alcohol having 1 to 6 carbon atoms to the sulfonated substance obtained by the sulfonation treatment, a neutralization treatment for neutralizing the esterified substance obtained by the esterification treatment, and a bleaching treatment for bleaching the neutralized substance obtained by the neutralization treatment, an α-SF salt-containing paste are obtained. The α-SF salt-containing paste obtained in this way generally contains, in addition to the α-SF salt, a by-product such as α-sulfofatty acid metal salt or alkyl sulfate metal salt, methanol, water, a fatty acid alkyl ester which is an unreacted raw material, and the like. The aforementioned bleaching treatment may be skipped.

The α-SF salt-containing paste may also be prepared in a manner in which the α-SF salt-containing paste obtained as above is cooled and then solidified, the solidified resultant is stored in a silo, a flexible container bag, or the like, and then the resultant is melted again so as to be restored into a paste. Furthermore, the α-SF salt-containing paste may be prepared by heating and melting a commercially available α-SF salt as it is or by adding an appropriate amount of water thereto.

In the aforementioned sulfonation treatment, a molar ratio of the sulfonation gas to the fatty acid alkyl ester as a raw material (molar ratio represented by "sulfonation gas/fatty acid alkyl ester") is preferably 1.05 to 1.13, more preferably 1.07 to 1.11, and even more preferably 1.07 to 1.10. If the molar ratio of sulfonation gas/fatty acid alkyl ester is within the above range, the content of the fatty acid ester in the component (A) is easily adjusted to be within the aforementioned desired preferred range. Furthermore, it is easy to inhibit the lengthening of the time required for the sulfonation treatment and to inhibit the decrease in yield of the α-SF salt.

[Flaking Treatment]

During the flaking treatment, at the time of making the α-SF salt-containing paste into solids by cooling, the paste is made into flat plate-like solids by using a flaker, a belt cooler, or the like, and then the flat plate-like solids are disintegrated using a disintegrator, thereby obtaining α-SF salt-containing flakes. At the time of making the α-SF salt-containing paste into solids by cooling, if necessary, the paste may be concentrated using a vacuum thin-film evaporator or the like.

Examples of the aforementioned flaker include a drum flaker manufactured by KATSURAGI IND. CO., LTD., a drum flaker FL manufactured by Mitsubishi Materials Corporation, and the like. Examples of the belt cooler include a double belt cooler or an NR-type double belt cooler manufactured by Nippon Belting Co., Ltd., a double belt cooling system manufactured by Sandvik, and the like. Examples of the disintegrator include a flake crusher FC manufactured by Hosokawa Micron Group, and the like.

[Noodle Preparing Step]

During the noodle preparing step, the α-SF salt-containing flakes are melted, put into an extrusion granulator or a kneader, and pass through a dice having an appropriate diameter, thereby obtaining noodles.

Examples of the extrusion granulator include PELLETER DOUBLE and TWIN DOME GRAN manufactured by Fuji Paudal co., ltd, a gear pelletizer and Extrud-O-Mix manufactured by Hosokawa Micron Group, and the like.

The aforementioned kneader is not particularly limited, and examples thereof include a continuous or batch-type kneader. The kneader also includes kneaders having a blade or the like which is for forcedly stirring and mixing the contents in the device.

Examples of the continuous kneader include a KRC kneader, a KEX extruder, and an SC processor manufactured by KURIMOTO, LTD., Extrud-O-Mix manufactured by Hosokawa Micron Group, a twin-screw/single-screw extruder and FEEDER RUDER manufactured by MORIYAMA, and the like. Examples of the batch-type kneader include a batch kneader/pressurizing kneader manufactured by KURIMOTO, LTD., a universal mixing and stirring machine manufactured by DALTON CORPORATION, a general mixer and a pressurizing kneader manufactured by MORIYAMA, a NAUTA MIXER manufactured by Hosokawa Micron Group, a Lödige mixer manufactured by MATSUBO Corporation, a pro-shear mixer manufactured by Pacific Machinery & Engineering Co., Ltd, and the like. In view of smoothly moving the kneaded substance to the next step, it is preferable to use the continuous kneader.

[Pelletizing Step]

During the pelletizing step, the α-SF salt-containing noodles are disintegrated in an arbitrary size by using a disintegrator or the like, thereby obtaining α-SF salt-containing pellets. Examples of the disintegrator include NIBBLER manufactured by Hosokawa Micron Group, and the like.

[Grinding Step]

During the grinding step, the aforementioned flakes, pellets, or noodles are ground by a grinder, thereby obtaining the component (A). Examples of the grinder include a hammer mill, a pin mill, and the like. Examples of the hammer mill include a feather mill FS manufactured by Hosokawa Micron Group, a Fitzmill manufactured by Fitz-Patrick Company, and the like.

The internal temperature of the grinder at the time of grinding is not particularly limited, but is preferably 30° C. to 50° C., more preferably 30° C. to 40° C., and even more preferably 33° C. to 38° C. If the internal temperature is equal to or higher than 30° C., the particle size distribution of the obtained particles is easily narrowed, and the occurrence of fine powder is easily inhibited. If the internal temperature is equal to or lower than 50° C., the stickiness of the particles can be easily reduced, and it is easy to inhibit the particles from adhering to the device. Therefore, the productivity is easily improved.

At the time of grinding, it is preferable to mount a screen on the grinder. For example, in a case where the amount of coarse powder is expected to increase, a screen with holes having a diameter of 2 mm is used, and in a case where the amount of fine powder is expected to increase, a screen with holes having a diameter of 3 to 5 mm is used.

The rotation frequency of the disintegration blade at the time of grinding is preferably 200 to 8,000 rpm, and more preferably 600 to 5,000 rpm. The higher the rotation frequency is, the easier it is for the particle size of the obtained particles to be small, and the lower the rotation frequency is, the easier it is for the particle size to be large. The circumferential speed of the tip of the disintegration blade is preferably 20 to 70 m/s, more preferably 30 to 60 m/s, and even more preferably 35 to 55 m/s. The grinding time is generally 5 seconds to 5 minutes. Multiple grinders may be arranged in series or in a row.

[Classifying Step]

During the classifying step, by using a classifying device, the particle size of the group of the component (A) is adjusted to be within a desired range. The classifying device is not particularly limited, and known classifying devices can be used. However, it is preferable to use sieves. Among the sieves, a gyro-type sieve, a flat sieve, and a shaking sieve are preferable. The gyro-type sieve is a sieve obtained by making a flat sieve, which slightly slants, performs horizontal circular motion. The flat sieve is a sieve obtained by making a flat sieve, which slightly slants, performs a reciprocating motion practically in parallel to the plane. The shaking sieve is a sieve that rapidly shakes in a direction which is practically perpendicular to the plane of the sieve. It is preferable that the sieving is performed for equal to or longer than 5 seconds. In order to improve the efficiency of sieving, tapping balls can be used.

Generally, the group of the component (A) before the classifying step contains fine powder in an amount of equal to or greater than 30% by mass, although the amount varies with the manufacturing conditions or the like.

If the content of the fine powder in the group of the component (A) is great, solidification easily proceeds during storage. Accordingly, for inhibiting the solidification, the amount of the fine powder in the group of the component (A) is adjusted by performing the classifying step, such that the content of the fine powder in the group of the component (A) is adjusted and becomes, for example, less than 20% by mass.

However, in the present invention, by coating the component (A) with the component (B), the solidification inhibitory properties are improved. Therefore, even when the amount of the fine powder in the group of the component (A) is equal to or greater than 20% by mass, it is possible to obtain a coated α-SF salt particle group having excellent solidification inhibitory properties. Furthermore, if the content of the fatty acid alkyl ester in the component (A) is 0.9% to 4.0% by mass, the solidification inhibitory properties are further improved.

Consequently, the content of the fine powder in the group of the component (A) is not particularly limited. As the group of the component (A), it is preferable to use a component in which the content of the fine powder may be 100% by mass or preferably equal to or less than 70% by mass, more preferably equal to or less than 60% by mass, and even more preferably equal to or less than 50% by mass, because then the aforementioned classifying operation can be skipped, and the productivity is improved. Furthermore, as the group of the component (A), it is preferable to use a component in which the content of the fine powder is equal to or greater than 20% by mass and more preferably equal to or greater than 30% by mass, because then the solidification inhibitory effect of the present invention can be more effectively obtained. If the content of the fine powder is great, the mean particle size of the particle group of the component (A) becomes small. In a case where such particles are formulated with a powder detergent, there may be a big difference in a particle size between the particles and other components, and the problem of separation may occur. In this respect, the content of the fine powder in the group of the component (A) is preferably equal to or less than 50% by mass.

The content of the fine powder in the group of the component (A) is preferably 20% to 70% by mass, more preferably 30% to 70% by mass, even more preferably 30% to 60% by mass, and particularly preferably 30% to 50% by mass.

As the component (A), a component is preferable in which the content of the fatty acid alkyl ester in the component (A) is 0.9% to 4.0% by mass, and the content of the fine powder in the group of the component (A) is equal to or greater than 20% by mass. If the aforementioned component (A) is used, the productivity becomes excellent, and it is easy to obtain a coated α-SF salt particle group having excellent solidification inhibitory properties.

[Maturing Step]

It is known that, in the flakes, noodles, pellets, and particles containing the α-SF salt (hereinafter, these will be collectively referred to as an "α-SF salt-containing solid" as well), there are a metastable crystalline state and a stable crystalline state which is formed by crystallizing the α-SF salt-containing solid. Furthermore, it is known that the solidification inhibitory properties of the α-SF salt-containing solid in the stable crystalline state (hereinafter, referred to as a "stable solid" as well) are better than those of the α-SF salt-containing solid in the metastable crystalline state (hereinafter, referred to as a "metastable solid" as well) (see PCT International Publication No. WO2009/054406).

Generally, it is difficult to form a metastable solid from an α-SF salt with high purity. If an α-SF salt is obtained through each of the aforementioned steps by using a fatty acid alkyl ester as a starting material, usually, in addition to the α-SF salt, a by-product such as an alkyl sulfate metal salt or an α-sulfofatty acid salt is generated. If the α-SF salt-containing solid contains such a by-product, the α-SF salt-containing solid easily becomes in a metastable state.

During the maturing step, the metastable solid is converted into a stable solid.

The method for converting the metastable solid into the stable solid is known, and examples thereof include the following methods (I-1) to (I-3).

(I-1) A method of keeping the metastable solid for at least 48 hours at a temperature of equal to or higher than 30° C. under a pressure of equal to or lower than 200,000 Pa.

(I-2) A method of keeping a melt, which is obtained by melting the metastable solid, for 5 minutes or longer at a temperature that is equal to or higher than the melting point of the metastable solid and is equal to or lower than the melting point of the stable solid.

(I-3) A method of applying a shearing force to a melt, which is obtained by melting the metastable solid, at a shearing rate of equal to or higher than 100 (1/s) at a temperature that is equal to or higher than the melting point of the metastable solid and is equal to or lower than 80° C.

The metastable solid and the stable solid can be easily differentiated from each other through thermal analysis using a differential scanning calorimeter. When the metastable solid is thermally analyzed using a differential scanning calorimeter, an observed heat absorption peak area S1 at a temperature of 50° C. to 130° C. is less than 50% of a heat absorption peak area S2 at a temperature of 0° C. to 130° C. In contrast, when the stable solid is thermally analyzed using a differential scanning calorimeter, an observed heat absorption peak area S1 at a temperature of 50° C. to 130° C. is equal to or greater than 50% of a heat absorption peak area S2 at a temperature of 0° C. to 130° C.

In the present invention, by coating the component (A) with the component (B), the solidification inhibitory properties are further improved. Therefore, even if the component (A) is the metastable solid, the solidification inhibitory properties are improved.

Accordingly, as the component (A), either the metastable solid or the stable solid may be used. It is preferable to use the metastable solid as the component (A), because then the maturing step can be skipped, and the productivity is improved.

Whether the component (A) is the metastable solid or the stable solid can be easily determined by performing X-ray diffractometry or microscopic observation on both of the solids, in addition to performing the aforementioned differential scanning calorimetry (see PCT International Publication No. WO2009/054406).

The content of the component (A) in the coated α-sulfofatty acid alkyl ester salt particles (hereinafter, referred to as "coated α-SF salt particles" as well) coated with the component (B) is, with respect to the total mass of the coated α-SF salt particles, preferably 70% to 99% by mass, more preferably 80% to 97% by mass, and even more preferably 85% to 90% by mass. If the content of the component (A) is equal to or greater than 70% by mass with respect to the total mass of the coated α-SF salt particles, the solubility of the coated α-SF salt particles is easily improved. If the content of the component (A) is equal to or less than 99% by mass with respect to the total mass of the coated α-SF salt particles, the solidification inhibitory effect is easily obtained.

<Component (B)>

The component (B) of the present embodiment is a coating component containing a zeolite particle group (component (b1)) having a mean particle size of equal to or greater than 0.8 μm and less than 3.8 μm as a zeolite particle group.

The component (B) may contain at least one kind (component (b2)) selected from a fatty acid alkyl ester, a higher alcohol having 8 to 22 carbon atoms, and polyethylene glycol.

The component (B) may contain optional components other than the component (b1) and the component (b2), within a range that does not impair the effect of the present invention.

In view of improving the solidification inhibitory properties, the component (B) preferably consists of the component (b1). In view of inhibiting the generation of dust at the time of manufacturing the coated α-SF salt particle group of the present invention, in view of improving the solidification inhibitory properties of the coated α-SF salt particle group containing a large amount of fine powder, and in view of improving the solidification inhibitory properties in a case where the component (A) is the metastable solid, the component (B) preferably consists of the component (b1) and the component (b2).

The content of the component (B) in the coated α-SF salt particles is, with respect to the total mass of the coated α-SF salt particles, preferably 1% to 30% by mass, more preferably 3% to 20% by mass, and even more preferably 10% to 15% by mass. If the content of the component (B) is equal to or greater than 1% by mass with respect to the total mass of the coated α-SF salt particles, the solidification inhibitory effect is easily obtained. Furthermore, if the content of the component (B) is equal to or less than 30% by mass with respect to the total mass of the coated α-SF salt particles, in a case where the coated α-SF salt particles are formulated with a powder detergent, it is easy to maintain a degree of freedom in formulating the particles with other components.

In the coated α-SF salt particles, the proportion of a surface area of the component (A) coated with the component (B) is preferably equal to or greater than 30%, more preferably equal to or greater than 50%, and even more preferably equal to or greater than 70%. The proportion may be 100%.

The ratio (coating ratio) of the coated area to the surface area of the component (A) can be checked by, for example, observing the surface of the coated α-SF salt particles by using a microscope (manufactured by ASAHI KOGAKUKI MANUF. CO., LTD., Handi Scope™) or a scanning electron microscope (for example, S-2380N manufactured by Hitachi, Ltd.) and an energy dispersive X-ray analyzer (for example, EMAX-7000 manufactured by HORIBA, Ltd.) and performing image analysis, surface element analysis, or the like.

<Component (b1)>

The component (b1) is a zeolite particle group having a mean particle size of equal to or greater than 0.8 μm and less than 3.8 μm. By coating the component (A) with the component (b1), the solidification of the coated α-SF salt particle group of the present invention can be inhibited.

The mean particle size of the component (b1) is equal to or greater than 0.8 μm and less than 3.8 μm. The mean particle size is preferably 1.0 to 3.4 μm, and more preferably 1.0 to 3.0 μm. If the mean particle size of the component (b1) is equal to or greater than 3.8 μm, the solidification inhibitory effect is not sufficiently obtained. If the mean particle size of the component (b1) is less than 0.8 μm, the zeolite particles are aggregated with each other, and the solidification inhibitory effect is not sufficiently obtained.

The smaller the mean particle size of the component (b1) is, the easier it is to obtain an excellent solidification inhibitory effect. However, if the mean particle size is too small, the zeolite particles are aggregated with each other, and the solidification inhibitory effect is not sufficiently obtained. In this respect, the lower limit of the mean particle size of the component (b1) is equal to or greater than 0.8 μm. The lower limit is preferably equal to or greater than 1.0 μm, and more preferably equal to or greater than 2.0 μm. In contrast, in view of obtaining an excellent solidification inhibitory effect, the upper limit of the mean particle size of the component (b1) is less than 3.8 μm. The upper limit is preferably equal to or less than 3.4 μm, more preferably equal to or less than 3.0 μm, and even more preferably equal to or less than 2.8 μm.

The mean particle size of the component (b1) is a volume-based median diameter measured by a device (for example, a particle size distribution analyzer (LS13 320, manufactured by Beckman Coulter, Inc.)) using a laser diffraction/scattering method.

As the component (b1), a natural substance or a synthetic product may be used. Examples of the zeolite of the component (b1) include A-type zeolite, P-type zeolite, faujasite-type zeolite, and the like. Among these, the A-type zeolite is preferable.

Examples of the zeolite particle group include the commercially available products shown in Table 1. Table 1 shows the mean particle size of the zeolite particle group as a commercially available product that is determined by the measurement method of the present invention.

TABLE 1

| Manufacturer of zeolite particle group | Mean particle size of zeolite particle group (μm) |
|---|---|
| Guangzhou Hengbang Fine Chemical | 4.0 to 4.6 |
| Chalco | 3.8 to 4.2 |
| Huiying Chemical | 4.2 |
| Yue Xiu Textiles | 4.7 |

The mean particle size of the zeolite particle group as a commercially available product shown in Table 1 is greater than the upper limit of the range of the mean particle size of the component (b1) of the present invention. Such a zeolite particle group is prepared by sieving, pulverizing, or the like such that the zeolite particle group has a desired mean particle size, and can be used as the component (b1) of the present invention.

Any one kind of the component (b1) may be used singly, or two or more kinds thereof may be used in combination.

The content of the component (b1) in the component (B) is, with respect to the total mass of the component (B), preferably 50% to 100% by mass, more preferably 80% to 100% by mass, and even more preferably 90% to 100% by mass. The content may be 100% by mass. If the content of the component (b1) in the component (B) is equal to or greater than 50% by mass, the solidification inhibitory effect is easily obtained.

The content of the component (b1) in the coated α-SF salt particles is, with respect to the total mass of the coated α-SF salt particles, preferably 1% to 30% by mass, more preferably 3% to 20% by mass, even more preferably 5% to 15% by mass, and particularly preferably 10% to 15% by mass. If the content of the component (b1) in the coated α-SF salt particles is equal to or greater than 1% by mass, the solidification inhibitory effect is easily obtained. If the content of the component (b1) in the coated α-SF salt particles is equal to or less than 30% by mass, in a case where the coated α-SF salt particles are formulated with a powder detergent, it is easy to maintain a degree of freedom in formulating the particles with other components.

<Component (b2)>

The component (b2) is at least one kind selected from a fatty acid alkyl ester, a higher alcohol having 8 to 22 carbon atoms, and polyethylene glycol.

Because the component (B) contains the component (b2), the solidification of the coated α-SF salt particle group of the present invention can be further inhibited. Furthermore, in view of making it easy to inhibit the generation of dust at the time of manufacturing the coated α-SF salt particle group of the present invention, in view of making it easy to improve the solidification inhibitory properties of the coated α-SF salt particle group containing a large amount of fine powder, and in view of making it easy to improve the solidification inhibitory properties in a case where the component (A) is the metastable solid, the component (B) preferably contains the component (b2).

Examples of the aforementioned fatty acid alkyl ester include the same compound as the compound represented by Formula (2) described above.

Examples of the higher alcohol having 8 to 22 carbon atoms include natural higher alcohols such as capryl alcohol, decyl alcohol, lauryl alcohol, myristyl alcohol, cetyl alcohol, stearyl alcohol, oleyl alcohol, 2-butyloctanol, isotridecyl alcohol, isohexadecyl alcohol, 2-butyldecanol, 2-hexyloctanol, 2-hexyldodecanol, 2-octyldecanol, 2-hexyldecanol, 2-octadecanol, and 2-dodecylhexadecanol or synthetic higher alcohols. Among the higher alcohols having 8 to 22 carbon atoms, those having 10 to 20 carbon atoms are preferable, and those having 14 to 18 carbon atoms are more preferable.

As the aforementioned polyethylene glycol, those having a weight-average molecular weight of 200 to 20,000 are preferable, and those having a weight-average molecular weight of 300 to 1,500 are more preferable.

Among the above components (b2), a fatty acid alkyl ester, and a higher alcohol having 8 to 22 carbon atoms are preferable, and a fatty acid methyl ester (ME) is particularly preferable. The aforementioned fatty acid alkyl ester may be the same as or different from the fatty acid alkyl ester which is a raw material at the time of manufacturing the α-SF salt.

Any one kind of the components (b2) may be used singly, or two or more kinds thereof may be used in combination.

The content of the component (b2) in the component (B) is, with respect to the total mass of the component (B), preferably 0% to 50% by mass, more preferably 0% to 20% by mass, and even more preferably 0% to 10% by mass. If the content of the component (b2) in the component (B) is within the aforementioned preferred range, the solidification inhibitory effect is easily obtained.

The content of the component (b2) in the coated α-SF salt particles is, with respect to the total mass of the coated α-SF salt particles, preferably equal to or less than 10% by mass, more preferably equal to or less than 5.0% by mass, and even more preferably equal to or less than 3.0% by mass. If the content of the component (b2) in the coated α-SF salt particles is equal to or less than 10% by mass, the solubility of the coated α-SF salt particles is easily improved.

In view of improving the solidification inhibitory properties of the coated α-SF salt particle group of the present invention, the component (B) preferably consists of the component (b1).

Furthermore, in view of inhibiting the generation of dust at the time of manufacturing the coated α-SF salt particle group of the present invention, in view of improving the solidification inhibitory properties of the coated α-SF salt particle group containing a large amount of fine powder, and in view of improving the solidification inhibitory properties in a case where the component (A) is the metastable solid, the component (B) preferably contains the component (b2) and more preferably consists of the component (b1) and the component (b2).

In a case where the component (B) contains the component (b2), the content of the component (b1) in the component (B) is, with respect to the total mass of the component (B), preferably 60% to 99.8% by mass, more preferably 80% to 99.5% by mass, and even more preferably 90% to 98% by mass. The content of the component (b2) in the component (B) is, with respect to the total mass of the component (B), preferably 0.2% to 40% by mass, more preferably 0.5% to 20% by mass, and even more preferably 2% to 10% by mass.

The mass ratio of the component (b2) to the component (b1) {component (b2)/component (b1)} is preferably 0.002 to 0.7, more preferably 0.005 to 0.25, and even more preferably 0.02 to 0.1.

The content of the component (b1) in the coated α-SF salt particles is, with respect to the total mass of the coated α-SF salt particles, preferably 1% to 30% by mass, more preferably 3% to 20% by mass, and even more preferably 10% to 15% by mass. The content of the component (b2) in the coated α-SF salt particles is, with respect to the total mass of the coated α-SF salt particles, preferably 0.1% to 10% by mass, and more preferably 0.3% to 5% by mass.

<Method for Manufacturing Coated α-SF Salt Particle Group>

The method for manufacturing the coated α-SF salt particle group of the present embodiment has a step of coating the component (A) with the component (B) (coating step).

The method for manufacturing the coated α-SF salt particle group of the present embodiment has, for example, a particle (A) manufacturing step of manufacturing the component (A) (particles (A)), a component (B) selecting step, and a coating step of coating the component (A) with the component (B).

The particle (A) manufacturing step is a step of manufacturing the component (A) by the aforementioned method for manufacturing the component (A).

That is, the particle (A) manufacturing step has a step of preparing an α-SF salt-containing paste (paste preparing step), a step of preparing flakes from the paste (flaking step), a step of preparing noodles from the flakes (noodle preparing step), a step of preparing pellets from the noodles (pelletizing step), and a step of obtaining particles by grinding the flakes, the noodles, or the pellets (grinding step).

The (noodle preparing step) and the (pelletizing step) are optional steps and may be skipped. Furthermore, after the (grinding step), a step of classifying the group of α-SF salt particles (classifying step) may be performed. In addition, after the (flaking step), the (noodle preparing step), and the (pelletizing step), a step of maturing the flaks, the noodles, or the pellets (maturing step) may be performed.

During the paste preparing step, for example, the following treatments are performed which include a sulfonation treatment for causing sulfonation by bringing a fatty acid alkyl ester as a raw material into contact with a sulfonation gas (SO3) or the like, an esterification treatment for causing esterification by adding a lower alcohol having 1 to 6 carbon atoms to the sulfonated substance obtained by the sulfonation treatment, a neutralization treatment for neutralizing the esterified substance obtained by the esterification treatment, and a bleaching treatment for bleaching the neutralized substance obtained by the neutralization treatment. The bleaching treatment may be skipped.

As described above, in the sulfonation treatment, by adjusting the molar ratio of sulfonation gas/fatty acid alkyl ester, the content of the fatty acid alkyl ester contained in the component (A) can be adjusted. Furthermore, by additionally performing the aforementioned classifying step, the particle size distribution of the group of the component (A) can be adjusted.

In the particle (A) manufacturing step, if the component (A) is manufactured in which the content of the fatty acid alkyl ester in the particles (A) is 0.9% to 4.0% by mass, it is easy to obtain a coated α-SF salt particle group having excellent solidification inhibitory properties with a high content of an α-SF salt which is an active component. Furthermore, even if either or both of the aforementioned maturing step and the classifying step are not performed, it is easy to obtain a coated α-SF salt particle group having excellent solidification inhibitory properties. In addition, even if the content of fine powder in the group of the particles (A) is equal to or greater than 20% by mass, it is easy to obtain a coated α-SF salt particle group having excellent solidification inhibitory properties.

The component (B) selecting step is a step of selecting a component as a zeolite particle group (b1) having a mean particle size of equal to or greater than 0.8 μm and less than 3.8 μm from zeolite particle groups before the coating step.

During the selecting step, the mean particle size (volume-based median diameter) of the zeolite particle group is measured by the aforementioned device using a laser diffraction/scattering method, and whether or not the mean particle size is within a desired range is checked. Then, a zeolite particle group satisfying a desired range of a mean particle size is selected as the component (b1) and used as a coating component for the component (A). In a case where a zeolite particle group does not satisfy the desired range of a mean particle size, the zeolite particle group can be subjected to sieving, pulverizing, or the like and then subjected again to the selecting step. The selecting step can be repeated (twice or more) until a zeolite particle group having a desired mean particle size is obtained.

In the coating step, the method for coating the component (A) with the component (B) can be appropriately set according to the composition of the component (B). Hereinafter, the coating treatment method will be described according to the composition of the component (B).

[(II-1): In Case where Component (B) Consists of Component (b1)]

In a case where the component (B) consists of the component (b1), examples of the method for coating the component (A) with the component (B) include a method of putting the component (A) and the component (B) into a mixer and mixing them together.

Either the component (A) or the component (B) may be put first into the mixer. Alternatively, both of them may be simultaneously put into the mixer.

The mixer is not particularly limited but is preferably a mixer used for dry mixing. Examples thereof include a horizontal cylindrical mixer, a container rotation-type mixer such as a V-type mixer, an agitated mixer, and the like.

[(II-2): In Case where Component (B) Contains Component (b1) and Component (b2)]

In a case where the component (B) contains the component (b1) and the component (b2), the coating method includes a step of coating the component (A) with the component (b1), and a step of coating the component (A) with the component (b2). Either the step of coating the component (A) with the component (b1) or the step of coating the component (A) with the component (b2) may be performed first. Alternatively, both of the steps may be simultaneously performed. In view of further improving the solidification inhibitory properties and in view of inhibiting the generation of dust, it is preferable to perform the step of coating the component (A) with the component (b2) and then perform the step of coating the component (A) with the component (b1).

Examples of the method for coating the component (A) with the component (b1) include the aforementioned method (II-1).

Examples of the method for coating the component (A) with the component (b2) include a method in which the component (A) or the component (A) coated with the component (b1) is put into a mixer such as an agitated mixer or a container rotation-type mixer, the component (b2) is added thereto while the component (A) is being kept flowing, and mixing the components together.

Examples of the method of adding the component (b2) include a method of spraying the component (b2), a method of adding the component (b2) dropwise, and the like. In view of inhibiting the generation of dust and further improving the solidification inhibitory properties, the spraying method is preferable.

Examples of the method of spraying the component (b2) include a method in which the component (A) or the component (A) coated with the component (b1) is put into a container rotation-type cylindrical mixer, and the component (b2) is sprayed from a spray nozzle provided in the mixer while the mixer is being rotated. It is preferable that the component (b2) is sprayed such that the component (b2) does not directly contact the inner wall surface of the mixer. The mixer may be a batch type or a continuous type. Furthermore, the number of baffles in the mixer or the shape thereof is not particularly limited.

The spray nozzle is not particularly limited, and examples thereof include a two-fluid nozzle spraying a gas and a liquid by mixing them together, a pressurizing nozzle performing spraying by applying a relatively high pressure, and the like. Examples of the two-fluid nozzle include a BIMV series and a BIMV. S series manufactured by H. IKEUCHI Co., Ltd., and the like. Examples of the pressurizing nozzle include a K series, a KB series, a VV series, a VVP series, and a VE series manufactured by H. IKEUCHI Co., Ltd., and the like.

At the time of spraying the component (b2), if necessary, the component (b2) may be heated so as to obtain a desired droplet diameter. However, if the temperature of the component (b2) is too high, in some cases, the component (b2) is excessively atomized due to the decrease in viscosity, and hence the spray pressure increases. Therefore, in order to perform spraying at a stable spray pressure, the liquid temperature of the component (b2) is preferably room temperature (20° C.) to 95° C.

<Powder Detergent>

The powder detergent of the present embodiment contains the aforementioned coated α-SF salt particle group.

The powder detergent of the present embodiment is easily manufactured by mixing the coated α-SF salt particle group with other detergent components.

Examples of the detergent components include an anionic surfactant such as a linear alkylbenzene sulfonic acid metal salt, α olefin sulfonic acid metal salt, an alkyl sulfate metal salt, or a salt of a metallic soap; a nonionic surfactant such as an alkylene oxide adduct of a higher alcohol or the like; an amphoteric surfactant; a cationic surfactant; an inorganic builder such as zeolite, sodium sulfate, or sodium sulfite; an alkaline agent such as sodium carbonate or potassium carbonate; a fluorescent agent; a bleaching agent; a bleaching activator; an enzyme; a fragrance; a colorant; a softener; a polymer builder such as cationized cellulose, powdered cellulose, or polysodium acrylate, and the like.

The content of the coated α-SF salt particle group in the powder detergent is not particularly limited, but is, with respect to the total mass of the powder detergent, preferably 1% to 80% by mass, more preferably 1% to 50% by mass, and even more preferably 5% to 40% by mass. If the content is within the above preferred range, the solidification of the powder detergent is easily inhibited, and the fluidity is easily improved.

The detergent with which the coated α-SF salt particle group of the present embodiment is formulated is not limited to the powder detergent. The coated α-SF salt particle group may also be formulated with, for example, a tablet-type or sheet-type solid detergent or a liquid detergent.

(Second Embodiment)

In a coated α-SF salt particle group according to a second embodiment of the present invention, α-sulfofatty acid alkyl ester salt particles (A) are coated with a zeolite particle group-containing coating component (B) and at least one kind (b2) selected from a fatty acid alkyl ester, a higher alcohol having 8 to 22 carbon atoms, and polyethylene glycol.

The mean particle size of the coated α-SF salt particle group in the present embodiment is the same as the mean particle size of the coated α-SF salt particle group in the first embodiment.

The bulk density of the coated α-SF salt particle group in the present embodiment is the same as the bulk density of the coated α-SF salt particle group in the first embodiment.

<Component (A)>

As the component (A) in the present embodiment, it is preferable to use the same component as the component (A) in the first embodiment.

As the group of the component (A) in the present embodiment, the same group as the group of the component (A) in the first embodiment can be used.

[Method for Manufacturing Component (A)]

The component (A) in the present embodiment can be manufactured by the same manufacturing method as the method for manufacturing the component (A) of the first embodiment.

The content of the component (A) in the coated α-SF salt particles in the present embodiment is the same as the content of the component (A) in the coated α-SF salt particles of the first embodiment.

<Component (B)>

The component (B) in the present embodiment is a coating component containing a zeolite particle group and at least one kind (b2) selected from a fatty acid alkyl ester, a higher alcohol having 8 to 22 carbon atoms, and polyethylene glycol.

By coating the component (A) with the coating component, it is possible to inhibit the solidification of the coated α-SF salt particle group of the present invention.

The mean particle size of the aforementioned zeolite particle group is not particularly limited. As the zeolite particle group, for example, the commercially available zeolite particle group shown in Table 1 may be used, or the aforementioned component (b1) may be used. As the zeolite particle group, those having a mean particle size within a range of 0.8 to 5.0 μm can be preferably used. In view of obtaining a better solidification inhibitory effect, it is preferable to use the component (b1) as the zeolite particle group.

As the component (b1), the same component (b1) as in the first embodiment can be used.

As the component (b2), the same component (b2) as in the first embodiment can be used.

The component (B) may contain optional components other than the zeolite particle group and the component (b2), within a range that does not impair the effect of the present invention.

The content of the component (B) in the coated α-SF salt particles in the present embodiment is the same as the content of the component (B) of the coated α-SF salt particles of the first embodiment.

The coating ratio of the coated α-SF salt particles in the present embodiment is the same as the coating ratio of the coated α-SF salt particles of the first embodiment.

The content of the zeolite particle group in the component (B) is, with respect to the total mass of the component (B), preferably 60% to 99.8% by mass, more preferably 80% to 99.5% by mass, and even more preferably 90% to 98% by mass.

The content of the component (b2) in the component (B) is, with respect to the total mass of the component (B), preferably 0.2% to 40% by mass, more preferably 0.5% to 20% by mass, and even more preferably 2% to 10% by mass.

In the present embodiment, because the component (B) contains the component (b2), the generation of dust at the time of manufacturing the coated α-SF salt particle group is easily inhibited, the solidification inhibitory properties of the coated α-SF salt particle group containing a large amount of fine powder are easily improved, and the solidification inhibitory properties in a case where the component (A) is a metastable solid are easily improved.

In the component (B), the mass ratio of the component (b2) to the zeolite particle group {component (b2)/zeolite particle group} is preferably 0.002 to 0.7, more preferably 0.005 to 0.25, and even more preferably 0.02 to 0.1.

The content of the zeolite particle group in the coated α-SF salt particles is, with respect to the total mass of the coated α-SF salt particles, preferably 1% to 30% by mass, more preferably 3% to 20% by mass, and even more preferably 10% to 15% by mass.

The content of the component (b2) in the coated α-SF salt particles is, with respect to the total mass of the coated α-SF salt particles, preferably 0.05% to 10% by mass, more preferably 0.1% to 5.0% by mass, and even more preferably 0.2% to 3.0% by mass.

As the zeolite particle group, it is preferable use the component (b1).

<Method for Manufacturing Coated α-SF Salt Particle Group>

The method for manufacturing coated α-SF salt particles of the present embodiment includes a step of coating the component (A) with the component (B) (coating step).

The method for manufacturing a coated α-SF salt particle group of the present embodiment includes, for example, a particle (A) manufacturing step of manufacturing the component (A) (particles (A)), and a coating step of coating the component (A) with the component (B).

The particle (A) manufacturing step is the same as in the first embodiment.

In the coating step, the method for coating the component (A) with the component (B) is not particularly limited. The coating step has, for example, a step of coating the component (A) with the zeolite particle group and a step of coating the component (A) with the component (b2). Either the step of coating the component (A) with the zeolite particle group or the step of coating the component (A) with the component (b2) may be performed first. Alternatively, both of the steps may be simultaneously performed. In view of further improving the solidification inhibitory properties and in view of inhibiting the generation of dust, it is preferable to perform the step of coating the component (A) with the component (b2) and then perform the step of coating the component (A) with the zeolite particle group.

Examples of the method for coating the component (A) with the zeolite particle group include the aforementioned method (II-1) in which the zeolite particle group is used instead of the component (b1).

Examples of the method for coating the component (A) with the component (b2) include the aforementioned method (II-2) in which the zeolite particle group is used instead of the component (b1).

As the zeolite particle group, the component (b1) may be used. In this case, before the coating step, a selecting step of selecting, as the component (b1), a zeolite particle group having a mean particle size of equal to or greater than 0.8 μm and less than 3.8 μm from zeolite particle groups is performed. The selecting step is the same as in the first embodiment.

<Powder Detergent>

The powder detergent of the present embodiment is the same as the powder detergent of the first embodiment, except that the coated α-SF salt particle group of the present embodiment (second embodiment) is used instead of the coated α-SF salt particle group of the first embodiment.

The detergent with which the coated α-SF salt particle group of the present embodiment is formulated is not limited to the powder detergent. For example, the coated α-SF salt particle group may be formulated with a tablet-type or sheet-type solid detergent or a liquid detergent.

(Third Embodiment)

<α-Sulfofatty Acid Alkyl Ester Salt-Containing Powder>

The group of α-sulfofatty acid alkyl ester salt particles (A) (component (A)) not being coated with the zeolite particle group-containing coating component (B) (component (B)) is easily solidified. Furthermore, the greater the content of fine powder in the aforementioned group is, the easier it is for the solidification to occur. However, if the content of the fatty acid alkyl ester in the component (A) is set to be equal to or greater than 0.9% by mass, even if the group of the component (A) is solidified, the component (A) is easily disintegrated (Reference Examples 3 to 5).

The α-sulfofatty acid alkyl ester salt-containing powder (hereinafter, referred to as "α-SF salt-containing powder" as well) according to a third embodiment of the present invention is a group of α-sulfofatty acid alkyl ester salt particles (A) (component (A)). The content of particles (fine powder) having a particle size of equal to or less than 355 μm in the α-SF salt-containing powder is equal to or greater than 20% by mass, and the content of the fatty acid alkyl ester in the particles (A) is 0.9% to 4.0% by mass.

<Component (A)>

As the component (A) in the present embodiment, the same component as the component (A) in the first embodiment can be used. Here, in the present embodiment, the component (A) is used in which the content of the fatty acid alkyl ester is 0.9% to 4.0% by mass with respect to the total mass of the component (A).

In a case where the component (A) is not coated with the component (B), in view of obtaining α-SF salt-containing powder having better solidification inhibitory properties, it is preferable to increase the content of the fatty acid alkyl ester in the component (A). The content of the fatty acid alkyl ester in the component (A) is, with respect to the total mass of the component (A), preferably equal to or greater than 1.5% by mass, and more preferably equal to or greater than 2.0% by mass. If the content of the fatty acid alkyl ester in the component (A) is the aforementioned preferred amount, it is easy to obtain α-SF salt-containing powder having excellent solidification inhibitory properties. The content of the fatty acid alkyl ester in the component (A) is, with respect to the total mass of the component (A), preferably equal to or less than 4.0% by mass, more preferably equal to or less than 3.5% by mass, and even more preferably equal to or less than 2.5% by mass. If the content of the fatty acid alkyl ester in the component (A) is the aforementioned preferred amount, it is easy to obtain α-SF salt-containing powder with a high content of an α-SF salt which is an active component.

The content of the fatty acid alkyl ester in the component (A) is, with respect to the total mass of the component (A), preferably 1.5% to 4.0% by mass, more preferably 1.5% to 3.5% by mass, even more preferably 2.0% to 3.5% by mass, and particularly preferably 2.0% to 2.5% by mass. If the content of the fatty acid alkyl ester in the component (A) is within the above preferred range, it is easy to obtain α-SF salt-containing powder with excellent solidification inhibitory properties and a high content of an active component.

As the group of the component (A) in the present embodiment, it is possible to use the same one as the group of the component (A) in the first embodiment. Here, in the present embodiment, the group of the component (A) is used in which the content of particles (fine powder) having a particle size of equal to or less than 355 μm in the group of the component (A) is equal to or greater than 20% by mass with respect to the total mass of the group of the component (A).

If the content of the fine powder in the group of the component (A) is equal to or greater than the aforementioned lower limit, in the method for manufacturing the component (A) that will be described later, a classification operation can be skipped, and the productivity is improved. In view of further improving the productivity, the content of the fine powder in the group of the component (A) is equal to or greater than 30% by mass with respect to the total mass of the group of the component (A). Furthermore, the content of the fine powder in the group of the component (A), with respect to the total mass of the group of the component (A), may be 100% by mass. The content is preferably equal to or less than 70% by mass, more preferably equal to or less than 60% by mass, and even more preferably equal to or less than 50% by mass. If the content of the fine powder in the group of the component (A) is equal to or less than the aforementioned upper limit, it is easy to obtain α-SF salt-containing powder having excellent solidification inhibitory properties.

The content of the fine powder in the group of the component (A) is, with respect to the total mass of the group of the component (A), preferably 20% to 70% by mass, more preferably 30% to 70% by mass, even more preferably 30% to 60% by mass, and particularly preferably 30% to 50% by mass. If the content of the fine powder in the group of the component (A) is within the aforementioned preferred range, it is easy to obtain α-SF salt-containing powder having excellent solidification inhibitory properties, and the productivity is improved.

<Method for Manufacturing α-SF Salt-Containing Powder>

The method for manufacturing α-SF salt-containing powder of the present embodiment is the same as the method for manufacturing the component (A) in the first embodiment.

Here, in the present embodiment, the component (A) is manufactured in which the content of the fatty acid alkyl ester in the component (A) is 0.9% to 4.0% by mass with respect to the total mass of the component (A), and the content of the fine powder in the group of the component (A) is equal to or greater than 20% by mass with respect to the total mass of the group of the component (A).

In the method for manufacturing the component (A), during the sulfonation treatment, a molar ratio of a sulfonation gas to the fatty acid alkyl ester as a raw material (molar ratio represented by "sulfonation gas/fatty acid alkyl ester") is preferably 1.05 to 1.13, more preferably 1.07 to 1.11, and even more preferably 1.07 to 1.10. If the molar ratio of sulfonation gas/fatty acid alkyl ester is within the above range, the content of the fatty acid ester in the component (A) can be easily adjusted to be within the aforementioned desired preferred range. Furthermore, it is easy to inhibit the lengthening of the time required for the sulfonation treatment and to inhibit the decrease in yield of the α-SF salt.

The α-SF salt-containing powder of the present embodiment has excellent solidification inhibitory properties. Accordingly, the manufacturing method thereof may not include the maturing step and/or the classifying step.

(Fourth Embodiment)

The α-SF salt-containing powder according to a fourth embodiment of the present invention is a group of coated α-sulfofatty acid alkyl ester salt particles (coated α-SF salt particles) in which the α-sulfofatty acid alkyl ester salt particles (A) (component (A)) are coated with a zeolite particle group-containing coating component (B) (component (B)). The content of particles (fine powder) having a particle size of equal to or less than 355 μm in the α-SF salt-containing powder according to the present embodiment is equal to or greater than 20% by mass with respect to the total mass of the α-SF salt-containing powder, and the content of the fatty acid alkyl ester in the component (A) is 0.9% to 4.0% by mass with respect to the total mass of the component (A).

The mean particle size of the coated α-SF salt-containing powder in the present embodiment is the same as the mean particle size of the α-SF salt-particle group in the first embodiment.

The bulk density of the α-SF salt-containing powder in the present embodiment is the same as the bulk density of the coated α-SF salt particle group in the first embodiment.

<Component (A)>

As the component (A) in the present embodiment, it is possible to use the same one as the component (A) in the third embodiment.

[Method for Manufacturing Component (A)]

The component (A) in the present embodiment can be manufactured by the same method as the method for manufacturing the component (A) in the first embodiment.

Here, in the present embodiment, the component (A) is manufactured in which the content of the fatty acid alkyl ester in the component (A) is 0.9% to 4.0% by mass with respect to the total mass of the component (A), and the content of fine powder in the component (A) is equal to or greater than 20% by mass with respect to the total mass of the group of the component (A).

The content of the component (A) in the coated α-SF salt particles of the present embodiment is the same as the content of the component (A) in the coated α-SF salt particles in the first embodiment.

<Component (B)>

The component (B) in the present embodiment is a zeolite particle group-containing coating component.

By coating the component (A) with the coating component, the solidification of the α-SF salt-containing powder can be further inhibited.

As the zeolite particle group of the present embodiment, it is possible to use a zeolite particle group other than the component (b1) such as the commercially available zeolite particle group shown in Table 1. In view of obtaining a better solidification inhibitory effect, it is preferable to use the component (b1) as the aforementioned zeolite particle group. However, in the present embodiment, even if a zeolite particle group other than the component (b1) is used, the solidification inhibitory effect can be obtained. As the zeolite particle group other than the component (b1), it is possible to preferably use a zeolite particle group (b3) (component (b3)) having a mean particle size of 3.8 to 5.0 μm.

The component (B) may contain at least one kind of component (b2) selected from a fatty acid alkyl ester, a higher alcohol having 8 to 22 carbon atoms, and polyethylene glycol.

As the component (b2), the same one as the component (b2) in the first embodiment can be used.

The component (B) may consists of, for example, the component (b3) or the component (b3) and the component (b2). Furthermore, the component (B) may contain optional components other than the component (b2) and the component (b3).

The content of the component (B) in the coated α-SF salt particles in the present embodiment is the same as the content of the component (B) in the coated α-SF salt particles of the first embodiment.

The coating ratio of the coated α-SF salt particles in the present embodiment is the same as the coating ratio of the coated α-SF salt particles of the first embodiment.

The content of the zeolite particle group in the component (B) is the same as the content of the component (b1) in the component (B) in the first embodiment.

The content of the zeolite particle group in the coated α-SF salt particles is the same as the content of the component b(1) in coated α-SF salt particles in the first embodiment.

The content of the component (b2) in the component (B) is the same as the content of the component (b2) in the component (B) in the first embodiment.

The content of the component (b2) in the coated α-SF salt particles is the same as the content of the component (b2) in the coated α-SF salt particles in the first embodiment.

In view of inhibiting the generation of dust at the time of manufacturing the α-SF salt-containing powder of the present embodiment, in view of improving the solidification inhibitory properties of the α-SF salt-containing powder containing a large amount of fine powder, and in view of improving the solidification inhibitory properties in a case where the component (A) is a metastable solid, it is preferable that the component (B) contains the component (b2).

In a case where the component (B) contains the component (b2), the content of the zeolite particle group in the component (B), the content of the component (b2) in the component (B), and the mass ratio of the component (b2) to the zeolite particle group in the component (B) are the same as the content of the zeolite particle group in the component (B), the content of the component (b2) in the component (B), and the mass ratio of the component (b2) to the zeolite particle group in the component (B) in the second embodiment respectively.

In a case where the component (B) contains the component (b2), the content of the zeolite particle group in the coated α-SF salt particles and the content of the component (b2) in the coated α-SF salt particles are the same as the content of the zeolite particle group in the coated α-SF salt particles and the content of the component (b2) in the coated α-SF salt particles in the second embodiment respectively.

<Method for Manufacturing α-SF Salt-Containing Powder>

The method for manufacturing α-SF salt-containing powder of the present embodiment has a step of coating the component (A) with the component (B) (coating step).

The method for manufacturing the α-SF salt-containing powder of the present embodiment has, for example, a particle (A) manufacturing step of manufacturing the component (A) (particles (A)) and a coating step of coating the component (A) with the component (B).

The particle (A) manufacturing step is a step of manufacturing the component (A) by the same manufacturing method as the method for manufacturing the component (A) of the first embodiment.

Here, in the present embodiment, the component (A) is manufactured in which the content of the fatty acid alkyl ester in the component (A) is 0.9% to 4.0% by mass with respect to the total mass of the component (A), and the content of the fine powder in the group of the component (A) is equal to or greater than 20% by mass with respect to the total mass of the group of the component (A).

The α-SF salt-containing powder of the present embodiment has excellent solidification inhibitory properties. Therefore, the manufacturing method thereof may not include the maturing step and/or the classifying step.

In the coating step, the method for coating the component (A) with the component (B) is appropriately set according to the composition of the component (B).

Examples of the coating method used in a case where the component (B) consists of the zeolite particle group include the method (II-1) of the first embodiment in which the zeolite particle group is used instead of the component (b1).

Examples of the coating method used in a case where the component (B) contains the component (b2) include the same method as the coating step of the second embodiment.

In the present embodiment, the component (b1) may be used as the zeolite particle group. In this case, before the coating step, a selecting step of selecting, as the component (b1), a zeolite particle group having a mean particle size of equal to or greater than 0.8 μm and less than 3.8 μm from zeolite particle groups is performed. The selecting step is the same as in the first embodiment.

<Powder Detergent>

The powder detergent containing the α-SF salt-containing powder of the third embodiment or the α-SF salt-containing powder of the fourth embodiment is the same as the powder detergent of the first embodiment, except that, instead of the coated α-SF salt particle group of the first embodiment, the α-SF salt-containing particles of the third embodiment or the α-SF salt-containing powder of the fourth embodiment is used.

The detergent with which the α-SF salt-containing powder of the third embodiment or the α-SF salt-containing powder of the fourth embodiment is formulated is not limited to the powder detergent. For example, the α-SF salt-containing powder may be formulated with a tablet-type or sheet-type solid detergent or a liquid detergent.

As described so far, the coated α-SF salt particle group of the present invention consists of the coated α-SF salt particles coated with a specific component (B). Accordingly, the solidification inhibitory properties of the coated α-SF salt particle group are excellent.

The coated α-SF salt particle group or the α-SF salt-containing powder of the present invention contains the component (A) in which the content of the fatty acid alkyl ester is 0.9% to 4.0% by mass. Accordingly, the solidification inhibitory properties of the coated α-SF salt particle group or the α-SF salt-containing powder are excellent.

EXAMPLES

Hereinafter, the present invention will be more specifically described using examples, but the present invention is not limited to the examples. In the present examples, unless otherwise specified, "%" represents "% by mass".

The raw materials used in the present examples are as below.

<Component (A)>

Tables 2 to 4 show the composition of a-1 to a-22 as groups of the component (A) used in the present examples, the amount of fine powder in a-1 to a-22, a degree of crystallinity, and a reaction molar ratio of S03/fatty acid methyl ester at the time of preparing a-1 to a-22.

For reference, particle size distributions of a-1 (amount of fine powder: 15% by mass) and a-10 (amount of fine powder; 40% by mass) are shown in Table 5.

a-1 to a-22 are groups of α-SF salt particles represented by Formula (1) described above in which $R^1$ is an alkyl group having 14 to 16 carbon atoms, $R^2$ is a methyl group, and M is sodium.

The method for preparing a-1 to a-22, the method for analyzing the composition thereof, and the method for measuring the degree of crystallinity are as described below.

TABLE 2

| | | a-1 | a-2 | a-3 | a-4 | a-5 | a-6 |
|---|---|---|---|---|---|---|---|
| Composition (% by mass) | AI (Di-Na salt) | 91.3 (4.6) | 91.3 (4.6) | 91.3 (4.6) | 91.3 (4.6) | 91.3 (4.6) | 91.3 (4.6) |
| | Sodium sulfate | 1.2 | 1.2 | 1.2 | 1.2 | 1.2 | 1.2 |
| | Sodium methyl sulfate | 3.8 | 3.8 | 3.8 | 3.8 | 3.8 | 3.8 |
| | Fatty acid methyl ester (ME) | 0.6 | 0.6 | 0.6 | 0.6 | 0.6 | 0.6 |
| | Moisture | 2.2 | 2.2 | 2.2 | 2.2 | 2.2 | 2.2 |
| | Others | 0.9 | 0.9 | 0.9 | 0.9 | 0.9 | 0.9 |
| | Total | 100 | 100 | 100 | 100 | 100 | 100 |

TABLE 2-continued

| | a-1 | a-2 | a-3 | a-4 | a-5 | a-6 |
|---|---|---|---|---|---|---|
| Amount of fine powder (% by mass) | 15 | 20 | 30 | 40 | 50 | 15 |
| Degree of crystallinity (%) | 75 | 75 | 75 | 75 | 75 | 20 |
| Reaction molar ratio of $SO_3$/fatty acid methyl ester | 1.15 | 1.15 | 1.15 | 1.15 | 1.15 | 1.15 |

TABLE 3

| | | a-7 | a-8 | a-9 | a-10 | a-11 | a-12 | a-13 | a-14 | a-15 |
|---|---|---|---|---|---|---|---|---|---|---|
| Composition (% by mass) | AI | 91.6 | 90.7 | 86.4 | 90.2 | 91.2 | 91.3 | 90.7 | 90.8 | 86.4 |
| | (Di-Na salt) | (6.3) | (6.6) | (5.8) | (5.8) | (5.7) | (4.6) | (5.8) | (6.0) | (5.8) |
| | Sodium sulfate | 1.0 | 1.1 | 1.3 | 1.2 | 1.2 | 1.2 | 1.1 | 1.1 | 1.3 |
| | Sodium methyl sulfate | 2.8 | 2.4 | 3.7 | 3.2 | 2.8 | 3.8 | 2.9 | 2.9 | 3.7 |
| | Fatty acid methyl ester (ME) | 1.3 | 1.9 | 3.4 | 1.1 | 1.3 | 0.6 | 1.2 | 1.4 | 3.4 |
| | Moisture | 2.1 | 2.1 | 2.7 | 2.6 | 2.1 | 2.2 | 2.3 | 2.3 | 2.7 |
| | Others | 1.2 | 1.8 | 2.5 | 1.7 | 1.4 | 0.9 | 1.8 | 1.5 | 2.5 |
| | Total | 100 | 100 | 100 | 100 | 100 | 100 | 100 | 100 | 100 |
| Amount of fine powder (% by mass) | | 40 | 40 | 40 | 40 | 40 | 40 | 40 | 40 | 40 |
| Degree of crystallinity (%) | | 75 | 73 | 76 | 50 | 57 | 20 | 40 | 22 | 23 |
| Reaction molar ratio of $SO_3$/fatty acid methyl ester | | 1.11 | 1.07 | 1.05 | 1.13 | 1.11 | 1.15 | 1.12 | 1.10 | 1.05 |

TABLE 4

| | | a-16 | a-17 | a-18 | a-19 | a-20 | a-21 | a-22 |
|---|---|---|---|---|---|---|---|---|
| Composition (% by mass) | AI | 91.3 | 90.7 | 86.4 | 90.7 | 86.4 | 90.7 | 86.4 |
| | (Di-Na salt) | (4.6) | (6.6) | (5.8) | (6.6) | (5.8) | (6.6) | (5.8) |
| | Sodium sulfate | 1.2 | 1.1 | 1.3 | 1.1 | 1.3 | 1.1 | 1.3 |
| | Sodium methyl sulfate | 3.8 | 2.4 | 3.7 | 2.4 | 3.7 | 2.4 | 3.7 |
| | Fatty acid methyl ester (ME) | 0.6 | 1.9 | 3.4 | 1.9 | 3.4 | 1.9 | 3.4 |
| | Moisture | 2.2 | 2.1 | 2.7 | 2.1 | 2.7 | 2.1 | 2.7 |
| | Others | 0.9 | 1.8 | 2.5 | 1.8 | 2.5 | 1.8 | 2.5 |
| | Total | 100 | 100 | 100 | 100 | 100 | 100 | 100 |
| Amount of fine powder (% by mass) | | 100 | 100 | 100 | 20 | 20 | 30 | 30 |
| Degree of crystallinity (%) | | 81 | 76 | 76 | 73 | 76 | 73 | 76 |
| Reaction molar ratio of $SO_3$/fatty acid methyl ester | | 1.15 | 1.07 | 1.05 | 1.07 | 1.05 | 1.07 | 1.05 |

TABLE 5

| | | a-1 | a-10 |
|---|---|---|---|
| Particle size distribution (% by mass) | 1400 μm. on | 0.1 | 0.2 |
| | 1180 μm. on | 2.2 | 2.4 |
| | 1000 μm. on | 4.4 | 5.3 |
| | 710 μm. on | 30.0 | 17.9 |
| | 500 μm. on | 30.2 | 19.8 |
| | 355 μm. on | 18.1 | 14.3 |
| | 250 μm. on | 3.8 | 13.8 |
| | 150 μm. on | 4.8 | 14.0 |
| | 150 μm. pass | 6.4 | 12.4 |
| 355 μm, pass (amount of fine powder) | | 15.0 | 40.2 |
| Particle size distribution of fine powder (% by mass) | 250 μm. on | 25.3 | 34.3 |
| | 150 μm. on | 32.0 | 34.8 |
| | 150 μm. pass | 42.7 | 30.9 |

a-1 to a-22 are as prepared as below.

(Method for Preparing a-1 to a-5)

[Paste Preparing Step]

Methyl palmitate (manufactured by Lion Corporation, trade name "PASTEL M-16") and methyl stearate (manufactured by Lion Corporation, trade name "PASTEL M-180") were mixed together at 80:20 (mass ratio).

330 kg of the aforementioned fatty acid methyl ester mixture and anhydrous sodium sulfate as a coloration inhibitor, which was in an amount of 5% by mass with respect to the fatty acid methyl ester mixture, were put into a reaction device having a volume of 1 kL equipped with a stirrer. While the resultant was being stirred, 110 kg of $SO_3$ gas (sulfonation gas) diluted with 4% by volume of nitrogen gas was blown thereinto over 3 hours at a constant velocity with bubbling so as to cause a reaction. The reaction temperature was kept at 80° C. The molar ratio of the sulfonation gas to the fatty acid methyl ester mixture (sulfonation gas/fatty acid methyl ester mixture) was 1.15.

The above reactant was moved to an esterification tank, and 14 kg of methanol was supplied thereto, thereby causing an esterification reaction at 80° C. The esterified substance obtained after the reaction was extracted from the esterification tank, and an equivalent amount of an aqueous sodium hydroxide solution was added thereto by using a line mixer, thereby continuously neutralizing the esterified substance.

Then, the neutralized substance was injected into a bleaching agent mixing line, 35% aqueous hydrogen peroxide was supplied thereto in an amount of 1% to 2% by mass with respect to the α-SF salt in terms of a pure content, and the aqueous hydrogen peroxide was mixed with the α-SF salt in a state where the temperature was being kept at 80° C., thereby obtaining an α-SF salt-containing paste.

[Flaking Step]

The obtained α-SF salt-containing paste was introduced into a vacuum thin-film evaporator (heat-transfer surface: 4 $m^2$, manufactured by Ballestra) at 200 kg/hr, concentrated at an inner wall heating temperature of 100° C. to 160° C. and a degree of vacuum of 0.01 to 0.03 MPa, and extracted as a melt with a temperature of 100° C. to 130° C.

The melt was cooled to 20° C. to 30° C. for 0.5 minutes by using a belt cooler (manufactured by NIPPON BELTING CO., LTD.). Subsequently, by using a disintegrator (manufactured by NIPPON BELTING CO., LTD.), α-SF salt-containing flakes were obtained.

[Maturing Step]

A 1 $m^3$ flexible container bag was filled with 600 kg of the α-SF salt-containing flakes and held in an environment with a temperature of 30° C. for 4 weeks, thereby converting the α-SF salt-containing flakes into stable solids.

[Grinding Step]

The flakes were put into a grinder (Fitzmill) and ground at 1,300 rpm, thereby obtaining α-SF salt particles.

[Classifying Step]

The obtained group of the α-SF salt particles was sieved using a sieve with 355 μm apertures, and fine powder passing through the sieve was cut. Then, the cut fine powder was returned to (mixed with) the α-SF salt particles such that the particles contained a predetermined amount of fine powder, thereby preparing a-1 to a-5.

(Method for Preparing a-6 and a-12)

a-6 and a-12 were prepared in the same manner as used for preparing a-1 to a-5, except that, after the α-SF salt-containing flakes were obtained, the maturing step was not performed.

(Method for Preparing a-7)

a-7 was prepared in the same manner as used for preparing a-1 to a-5, except that, in the paste preparation step, the molar ratio of the sulfonation gas to the fatty acid methyl ester mixture (sulfonation gas/fatty acid methyl ester mixture) was set to be 1.11.

(Method for Preparing a-8, a-19, and a-21)

a-8, a-19, and a-21 were prepared in the same manner as used for preparing a-1 to a-5, except that, in the paste preparation step, the molar ratio of the sulfonation gas to the fatty acid methyl ester mixture (sulfonation gas/fatty acid methyl ester mixture) was set to be 1.07.

(Method for Preparing a-9, a-20, and a-22)

a-9, a-20, and a-22 were prepared in the same manner as used for preparing a-1 to a-5, except that, in the paste preparation step, the molar ratio of the sulfonation gas to the fatty acid methyl ester mixture (sulfonation gas/fatty acid methyl ester mixture) was set to be 1.05.

(Method for Preparing a-10)

a-10 was prepared in the same manner as used for preparing a-1 to a-5, except that, in the paste preparing step, the molar ratio of the sulfonation gas to the fatty acid methyl ester mixture (sulfonation gas/fatty acid methyl ester mixture) was set to be 1.13, and in the maturing step, the α-SF salt-containing flakes were kept for 2 weeks in an environment with a temperature of equal to or higher than 30° C.

(Method for Preparing a-11)

a-11 was prepared in the same manner as used for preparing a-7, except that, in the maturing step, the α-SF salt-containing flakes were kept for 2 weeks in an environment with a temperature of equal to or higher than 30° C.

(Method for Preparing a-13)

a-13 was prepared in the same manner as used for preparing a-1 to a-5, except that, in the paste preparing step, the molar ratio of the sulfonation gas to the fatty acid methyl ester mixture (sulfonation gas/fatty acid methyl ester mixture) was set to be 1.12, and in the maturing step, the α-SF salt-containing flakes were kept for 1 weeks in an environment with a temperature of equal to or higher than 30° C.

(Method for Preparing a-14)

a-14 was prepared in the same manner as used for a-6 and a-12, except that, in the paste preparing step, the molar ratio of the sulfonation gas to the fatty acid methyl ester mixture (sulfonation gas/fatty acid methyl ester mixture) was set to be 1.10.

(Method for Preparing a-15)

a-15 was prepared in the same manner as used for preparing a-14, except that, in the paste preparing step, the molar ratio of the sulfonation gas to the fatty acid methyl ester mixture (sulfonation gas/fatty acid methyl ester mixture) was set to be 1.05.

(Method for Preparing a-16)

In the same manner as used for preparing a-1 to a-5, the flaking step, the maturing step, and the grinding step were performed. Then, in the classifying step, the group of the α-SF salt particles was sieved using a sieve with apertures with a size of 355 μm, and the fine powder passing through the sieve was collected, thereby preparing a-16.

(Method for Preparing a-17)

a-17 was prepared in the same manner as used for preparing a-16, except that, in the paste preparing step, the molar ratio of the sulfonation gas to the fatty acid methyl ester mixture (sulfonation gas/fatty acid methyl ester mixture) was set to be 1.07.

(Method for Preparing a-18)

a-18 was prepared in the same manner as used for preparing a-16, except that, in the paste preparing step, the molar ratio of the sulfonation gas to the fatty acid methyl ester mixture (sulfonation gas/fatty acid methyl ester mixture) was set to be 1.05.

(Method for Measuring Degree of Crystallinity)

As a differential scanning calorimeter, DSC6220 manufactured by Seiko Instruments Inc was used. 20 g of a sample was ground using a TRIO BLENDER (manufactured by Trio Science Co., Ltd.), and 5 to 30 mg of the obtained resultant was put into a sample pan made of silver, heated to 130° C. from 0° C. at a rate of 2° C./min, and thermally analyzed.

At this time, from a heat absorption peak area S1 at a temperature of 50° C. 130° C. and a heat absorption peak area S2 at a temperature of 0° C. to 130° C., the value of 100×S1/S2 was determined and taken as a degree of crystallinity (%). Each of the area S1 and the area S2 was determined by performing "automatic splitting time integration" by using the software attached to the differential scanning calorimeter. If an exothermic peak was checked at a temperature of 50° C. to 130° C., a value obtained by subtracting the absolute value of the exothermic peak from the heat absorption peak area at a temperature of 50° C. to 130° C. was taken as S1. If an exothermic peak was checked at a temperature of 0° C. to 130° C., a value obtained by subtracting the absolute value of the exothermic peak from the heat absorption peak area at a temperature of 0° C. to 130° C. was taken as S2.

(Method for Analyzing Compositions of a-1 to a-22)

The compositions of a-1 to a-22 were analyzed as below.

[Method for Measuring AI]

The total content (AI) of the α-SF salt and the α-sulfofatty acid dialkali salt (Di-Na salt) was measured as below.

The α-SF salt-containing flakes (for a-1 to a-5, a-7 to a-11, a-13, and a-16 to a-22, the flakes obtained after the maturing step; for a-6, a-12, a-14, and a-15, the flakes obtained after the flaking step; the same shall be applied to the following measurement method) was accurately weighed out in an amount of about 0.2 g into a volumetric flask having a volume of 200 mL, deionized water (distilled water) was added thereto up to a gauge line, and the sample was dissolved in the deionized water by using ultrasonic waves. After being dissolved, the sample was cooled to a temperature of about 25° C., 5 mL of the aqueous solution of the sample was moved to a titration bottle by using a hole pipette, and 25 mL of a methylene blue indicator and 15 mL of chloroform were added thereto. Thereafter, 5 mL of 0.004 mol/L benzethonium chloride solution was added thereto, and then titration was performed using a 0.002 mol/L sodium alkylbenzene sulfonate solution. Whenever the titration was performed, the titration bottle was caped, vigorously shaken, and then allowed to stand. At a point in time when the colors of two separating layers were found to be the same as each other against a white board in the background was regarded as being the end point of the titration.

In the same manner as described above, a blank test (performed in the same manner as described above except that the sample was not used) was performed, and from a difference of a titration amount of the sodium alkylbenzene sulfonate solution, the content of AI in the component (A) was calculated from the following equation.

*AI* content (% by mass)=(titration amount in blank test (mL)−titration amount (mL))×0.002(mol/L)×content of α-SF salt/(amount of sample collected(g)×5 (mL)/200 (mL))/10

[Method for Measuring Content of α-Sulfofatty Acid Dialkali Salt (Di-Na Salt)]

The content of the α-sulfofatty acid dialkali salt in the component (A) was measured as below.

A standard α-sulfofatty acid dialkali salt was accurately weighed out in an amount of 0.02 g, 0.05 g, and 0.1 g respectively into a volumetric flask having a volume of 200 mL, water in an amount of about 50 mL and ethanol in an amount of about 50 mL were added thereto, and the salt was dissolved using ultrasonic waves. After being dissolved, the salt was cooled to a temperature of about 25° C., methanol was added thereto accurately up to a gauge line, and the resultant was taken as a standard solution. The standard solution in an amount of about 2 mL was filtered using a 0.45 μm chromatographic disk and analyzed by high-performance liquid chromatography under the following measurement conditions. From the peak area, a calibration curve was plotted.

<<Measurement Conditions of High-Performance Liquid Chromatography>>

Device: LC-6A (manufactured by Shimadzu Corporation)

Column: Nucleosil 5SB (manufactured by GL Sciences Inc.)

Column temperature: 40° C.

Detector: differential refractive index detector RID-6A (manufactured by Shimadzu Corporation)

Mobile phase: $H_2O$ of 0.7% sodium perchlorate/$CH_3OH$=1/4 (volume ratio) solution Flow rate: 1.0 mL/min Injection amount: 100 μL Thereafter, the α-SF salt-containing flakes were accurately weighed out in an amount of about 0.8 g into a volumetric flask having a volume of 200 mL, water in an amount of about 50 mL and ethanol in an amount of about 50 mL were added thereto, and the flakes were dissolved. After dissolution, the solutoin was cooled to a temperature of about 25° C., methanol was added thereto accurately up to a gauge line, and the resultant was taken as a sample solution. The sample solution in an amount of about 2 mL was filtered using a 0.45 μm chromatographic disk and analyzed by high-performance liquid chromatography under the same conditions as described above. By using the aforementioned calibration curve, the concentration of the α-sulfofatty acid dialkali salt in the sample solution was determined, and the content (% by mass) of the α-sulfofatty acid dialkali salt in the component (A) was calculated.

[Method for Measuring Content of Sodium Sulfate and Sodium Methyl Sulfate]

The content of sodium sulfate and sodium methyl sulfate in the component (A) was measured as below.

Each of the standard sodium sulfate and the standard sodium methyl sulfate was accurately weighed out in an amount of 0.01 g, 0.02 g, 0.05 g, and 0.1 g into a volumetric flask having a volume of 1,000 mL, deionized water (distilled water) was added thereto up to a gauge line, and dissolution was performed using ultrasonic waves. After the dissolution, the solutoin was cooled to a temperature of about 25° C., and the resultant was taken as a standard solution. The standard solution in an amount of about 2 mL was filtered using a 0.45 μm chromotographic disk and subjected to ion chromatography under the following measurement conditions, and from peak areas of the standard solutions of the sodium methyl sulfate and the sodium sulfate, calibration curves were plotted.

<<Measurement Conditions of Ion Chromatography>>

Device: DX-500 (manufactured by Nippon Dionex K. K.)

Detector: conductivity detector CD-20 (manufactured by Nippon Dionex K. K.)

Pump: IP-25 (manufactured by Nippon Dionex K. K.)

Oven: LC-25 (manufactured by Nippon Dionex K. K.))

Integrator: C-R6A (manufactured by Shimadzu Corporation)

Separation column: AS-12A (manufactured by Nippon Dionex K. K.))

Guard column: AG-12A (manufactured by Nippon Dionex K. K.)

Eluent: aqueous solution of 2.5 mM $Na_2CO_3$/2.5 mM NaOH/5% (volume) acetonitrile Flow rate of eluent: 1.3 mL/min Regenerating liquid: pure water Column temperature: 30° C.

Loop volume: 25 μL

Then, α-SF salt-containing flakes were accurately weighed out in an amount of about 0.2 g into a 200 mL volumetric flaks, deionized water (distilled water) was added thereto up to a gauge line, and dissolution was performed using ultrasonic waves. After the dissolution, the solution was cooled to a temperature of about 25° C. and taken as a sample solution. The sample solution in an amount of about 2 mL was filtered using a 0.45 μm chromatographic disk and analyzed by ion chromatography under the same measurement conditions as described above. By using the calibration curve plotted as above, the concentration of the sodium sulfate and the concentration of the sodium methyl sulfate in the sample solution were determined, and the content (% by mass) of the sodium sulfate and the content of the sodium methyl sulfate in the component (A) were calculated.

[Method for Measuring Content of Fatty Acid Methyl Ester (ME)]

The content of the fatty acid methyl ester in the component (A) was measured as below. A standard fatty acid methyl ester was accurately weighed out in an amount of 0.02 g, 0.10 g, and 0.20 g respectively into a volumetric flask having a volume of 50 mL, methanol was added thereto up to a gauge line, and dissolution was performed using ultrasonic waves. After the dissolution, the solution was cooled to a temperature of about 25° C. and taken as a standard solution. The standard solution in an amount of about 2 mL was filtered using a 0.45 μm chromatographic disk and subjected to high-performance liquid chromatography under the following measurement conditions. From the peak area thereof, a calibration curve was plotted.

<<Measurement Conditions of High-Performance Liquid Chromatography>>

Device: LC-10AT (manufactured by Shimadzu Corporation)

Column: Inertsil ODS-2 (manufactured by GL Sciences Inc.)

Column temperature: 40° C.

Detector: differential refractive index detector RID-6A (manufactured by Shimadzu Corporation)

Mobile phase: mixed solution of $H_2O/CH_3OH$=5/95 (volume ratio)

Flow rate: 1.0 mL/min

Injection amount: 100 μL

Thereafter, α-SF salt-containing flakes were accurately weighed out in an amount of about 4.0 g into a volumetric flask having a volume of 50 mL, methanol was added thereto up to a gauge line, and dissolution was performed using ultrasonic waves. After the dissolution, the resultant was cooled to a temperature of about 25° C. and taken as a sample solution. The sample solution in an amount of about 2 mL was filtered using a 0.45 μm chromatographic disk and then subjected to high-performance liquid chromatography under the same measurement conditions as described above. By using the aforementioned calibration curve, the concentration of the fatty acid methyl ester in the sample solution was determined, and the content (% by mass) of the fatty acid methyl ester in the component (A) was calculated.

[Method for Measuring Moisture Amount: Karl Fischer Method]

The α-SF salt-containing flakes were made into a ground substance by being finely ground. The ground substance was collected in an amount of about 0.05 g, the moisture amount in the ground substance was measured using a Karl Fischer moisture meter MKC-210 (manufactured by KYOTO ELECTRONICS MANUFACTURING CO., LTD.), and the moisture amount (% by mass) in the component (A) was calculated.

<Component (B)>

<Component (b1)> b1-1: A-type zeolite (mean particle size: 1.0 μm)

b1-2: A-type zeolite (mean particle size: 2.5 μm)

b1-3: A-type zeolite (mean particle size: 2.7 μm)

b1-4: A-type zeolite (mean particle size: 3.4 μm)

<Component (b1')> b1'-1: A-type zeolite (mean particle size: 0.5 μm)

b1'-2: A-type zeolite (mean particle size: 4.0 μm), manufactured by Guangzhou Hengbang Fine Chemical Co., Ltd., 4A zeolite b1-1 to b1-4 and b1'-1 were prepared by grinding 4A zeolite (mean particle size: 4.0 μm) manufactured by Guangzhou Hengbang Fine Chemical Co., Ltd used as b1'-2 by using a mortar such that the zeolite had a predetermined mean particle size.

<Component (b2)> b2-1: ME, fatty acid methyl ester (number of carbon atoms of the fatty acid: 16 to 18), manufactured by Emery oleochemicals, C16/C18=85/15 (mass ratio)

Examples 1 to 33, Comparative Examples 1 to 7, and Reference Examples 1 to 11

Examples 1 to 12 and 25 to 33, Comparative Examples 1 to 7, and Reference Examples 6 to 11

According to the compositions shown in Tables 6, 8, and 10, the group of the component (A) and the component (b1) were put into a container rotation-type mixer such that the components were mixed together, thereby obtaining coated α-SF salt particle groups of Examples 1 to 12 and 25 to 33.

Coated α-SF salt particle groups of Comparative Examples 1 to 7 and Reference examples 6 to 11 were obtained in the same manner as described above, except that the (b1') component was used instead of the component (b1). The coated α-SF salt particle groups of Reference examples 6 to 11 are examples of the α-SF salt-containing powder of the fourth embodiment described above, and the component (b1'-2) used in these examples corresponds to the (b3) component of the fourth embodiment.

Examples 13 to 24 and Reference Examples 1 and 2

According to the composition shown in Table 7, the group of the component (A) was put into the container rotation-type mixer, and in a state where the group of the component (A) was flowing, the component (b2) was sprayed thereto. After the spraying of the component (b2) was finished, the component (b1) or the (b1') component was put into the mixer such that the components were mixed together, thereby obtaining coated α-SF salt particle groups of Examples 13 to 24 and Reference Examples 1 and 2.

Reference Examples 3 to 5

As Reference Examples 3 to 5, a-16 to a-18 were used as they are (the Reference Examples 4 and 5 are examples of the coated α-SF salt particles of the third embodiment described above. Hereinafter, the coated α-SF salt particle groups of Reference Examples 3 to 5 will be referred to as coated α-SF salt particle groups as in other examples).

Tables 6 to 10 show the composition of the obtained coated α-SF salt particle groups (formulation component and content (part by mass)).

If the column of the formulation component in the table remains blank, it means that the formulation component is not formulated.

For the coated α-SF salt particle group of each example, the content of fine powder (particles having a particle size of equal to or less than 355 μm) was measured as below. The measurement results are shown in Tables 6 to 10.

Furthermore, for the coated α-SF salt particle group of each example, the solidification inhibitory properties were evaluated as below. The evaluation results are shown in Tables 6 to 10.

[Measurement of Content of Fine Powder]

The coated α-SF salt particle group of each example was sieved using a sieve having apertures with a size of 355 μm, and from the amount of fine powder passing through the sieve, the content of the fine powder was calculated by the following equation.

Content of fine powder (% by mass)=(mass of fine powder passing through sieve/total mass of coated α-SF salt particle group remaining on the sieve)×100

[Evaluation of Solidification Inhibitory Properties]

The solidification inhibitory properties of the coated α-SF salt particle group of each example were evaluated by the following solidification index.

<<Method for Measuring Solidification Index>>

85 parts by mass of a-1 and 15 parts by mass of b1'-2 were put into the container rotation-type mixer such that they were mixed together, thereby obtaining a coated α-SF salt particle group. The coated α-SF salt particle group was taken as a standard sample.

80 g of the standard sample was put into a cylindrical cell having an inner diameter of 50 mm and a height of 100 mm and allowed to stand for 1 week under a load of 2 kg in an environment with a temperature of 40° C., thereby obtaining a cylindrical molded material. The molded material was taken out, and by using a FORCE GAUGE (model No. body: MX-500N, detection portion: ZP-500N) manufactured by IMDA, Incorporated, the detection portion was lowered from the upper portion under a condition of 5.32 mm/sec. A load was slowly imposed on the entirety of the upper surface of the molded material, and a maximum load (kgf) applied thereto until the molded material was destroyed was measured. The maximum load was measured 3 times, and the average ($W_0$) thereof was determined.

In the same manner as described above, a cylindrical molded material of the coated α-SF salt particle group of each example was obtained. Then, in the same manner as described above, a maximum load (kgf) applied thereto until the molded material was destroyed was measured. For each molded material, the maximum load was measured 3 times, and the average ($W_1$) of the maximum loads measured 3 times was determined for each example.

Then, by the following equation, a solidification index was calculated.

$$\text{Solidification index}=10\times(W_1/W_0)$$

The smaller the solidification index is, the better the evaluation result of solidification inhibitory properties can be.

TABLE 6

| | | | | Examples | | | | | | | | | | | |
|---|---|---|---|---|---|---|---|---|---|---|---|---|---|---|---|
| | | | | 1 | 2 | 3 | 4 | 5 | 6 | 7 | 8 | 9 | 10 | 11 | 12 |
| Composition (part by mass) | Group of component (A) | | a-1 | 85 | 85 | | | | 85 | | | | | | |
| | | | a-2 | | | 85 | | | | 85 | | | | | |
| | | | a-3 | | | | 85 | | | | 85 | | | | |
| | | | a-4 | | | | | | | | | 85 | | | |
| | | | a-5 | | | | | 85 | | | | | 85 | 85 | |
| | | | a-6 | | | | | | | | | | | | 85 |
| | Component (B) | Component (b1) | b1-1 | 15 | | | | | | | | | | | |
| | | | b1-2 | | 15 | 15 | 15 | 15 | | | | | | | |
| | | | b1-3 | | | | | | 15 | 15 | 15 | 15 | 15 | | 15 |
| | | | b1-4 | | | | | | | | | | | 15 | |
| | | Component (b1') | b1'-1 | | | | | | | | | | | | |
| | | | b1'-2 | | | | | | | | | | | | |
| | Total | | | 100 | 100 | 100 | 100 | 100 | 100 | 100 | 100 | 100 | 100 | 100 | 100 |
| Content of fine powder (% by mass) | | | | 17 | 17 | 22 | 32 | 53 | 17 | 23 | 31 | 40 | 52 | 50 | 17 |
| Solidification index | | | | 1 | 2 | 3 | 5 | 11 | 6 | 8 | 10 | 11 | 14 | 13 | 10 |

TABLE 7

| | | | | Examples | | | | | | | | | | Reference Examples | | Examples | |
|---|---|---|---|---|---|---|---|---|---|---|---|---|---|---|---|---|---|
| | | | | 13 | 14 | 15 | 16 | 17 | 18 | 19 | 20 | 21 | 22 | 1 | 2 | 23 | 24 |
| Composition (part by mass) | Group of component (A) | | a-1 | 85 | | | | | 85 | | | | | | | | |
| | | | a-2 | | 85 | | | | | 85 | | | | | | | |
| | | | a-3 | | | 85 | | | | | 85 | | | 85 | 85 | | |
| | | | a-4 | | | | 85 | | | | | 85 | | | | | |
| | | | a-5 | | | | | 85 | | | | | 85 | | | | |
| | | | a-6 | | | | | | | | | | | | | 85 | 85 |
| | Component (B) | Component (b1) | b1-1 | | | | | | | | | | | | | | |
| | | | b1-2 | | | | | | | | | | | | | | |
| | | | b1-3 | 15 | 15 | 15 | 15 | 15 | 15 | 15 | 15 | 15 | 15 | | | 15 | 15 |
| | | | b1-4 | | | | | | | | | | | | | | |
| | | Component (b2) | b2-1 | 0.5 | 0.5 | 0.5 | 0.5 | 0.5 | 1.0 | 1.0 | 1.0 | 1.0 | 1.0 | 0.5 | 1.0 | 0.5 | 1.0 |
| | | Component (b1') | b1'-1 | | | | | | | | | | | | | | |
| | | | b1'-2 | | | | | | | | | | | 15 | 15 | | |
| | Total | | | 100.5 | 100.5 | 100.5 | 100.5 | 100.5 | 101 | 101 | 101 | 101 | 101 | 100.5 | 101 | 100.5 | 101 |
| Content of fine powder (% by mass) | | | | 15 | 20 | 30 | 40 | 51 | 13 | 19 | 31 | 42 | 50 | 33 | 31 | 14 | 14 |
| Solidification index | | | | 6 | 7 | 9 | 10 | 12 | 4 | 7 | 9 | 11 | 12 | 14 | 13 | 4 | 1 |

TABLE 8

| | | | | Comparative Examples | | | | | | |
|---|---|---|---|---|---|---|---|---|---|---|
| | | | | 1 | 2 | 3 | 4 | 5 | 6 | 7 |
| Composition (part by mass) | Group of component (A) | | a-1 | 85 | 85 | | | | | |
| | | | a-2 | | | 85 | | | | |
| | | | a-3 | | | | 85 | | | |
| | | | a-4 | | | | | 85 | | |
| | | | a-5 | | | | | | 85 | |
| | | | a-6 | | | | | | | 85 |
| | Component (B) | Component (b1) | b1-1 | | | | | | | |
| | | | b1-2 | | | | | | | |
| | | | b1-3 | | | | | | | |
| | | | b1-4 | | | | | | | |
| | | Component (b1') | b1'-1 | 15 | | | | | | |
| | | | b1'-2 | | 15 | 15 | 15 | 15 | 15 | 15 |
| | Total | | | 100 | 100 | 100 | 100 | 100 | 100 | 100 |
| Content of fine powder (% by mass) | | | | 17 | 16 | 20 | 30 | 40 | 51 | 17 |
| Solidification index | | | | 28 | 10 | 12 | 15 | 21 | 25 | 21 |

TABLE 9

| | | | | Examples | | | | | | | | |
|---|---|---|---|---|---|---|---|---|---|---|---|---|
| | | | | 25 | 26 | 27 | 28 | 29 | 30 | 31 | 32 | 33 |
| Composition (part by mass) | Group of component (A) | | a-7 | 85 | | | | | | | | |
| | | | a-8 | | 85 | | | | | | | |
| | | | a-9 | | | 85 | | | | | | |
| | | | a-10 | | | | 85 | | | | | |
| | | | a-11 | | | | | 85 | | | | |
| | | | a-12 | | | | | | 85 | | | |
| | | | a-13 | | | | | | | 85 | | |
| | | | a-14 | | | | | | | | 85 | |
| | | | a-15 | | | | | | | | | 85 |
| | Component (B) | Component (b1) | b1-1 | | | | | | | | | |
| | | | b1-2 | | | | | | | | | |
| | | | b1-3 | 15 | 15 | 15 | 15 | 15 | 15 | 15 | 15 | 15 |
| | | | b1-4 | | | | | | | | | |
| | | Component (b1') | b1'-1 | | | | | | | | | |
| | | | b1'-2 | | | | | | | | | |
| | Total | | | 100 | 100 | 100 | 100 | 100 | 100 | 100 | 100 | 100 |
| Content of fine powder (% by mass) | | | | 40 | 40 | 40 | 40 | 40 | 40 | 40 | 40 | 40 |
| Solidification index | | | | 9 | 8 | 7 | 12 | 11 | 19 | 12 | 10 | 4 |

TABLE 10

| | | | | Reference Examples | | | | | | | | |
|---|---|---|---|---|---|---|---|---|---|---|---|---|
| | | | | 3 | 4 | 5 | 6 | 7 | 8 | 9 | 10 | 11 |
| Composition (part by mass) | Group of component (A) | | a-16 | 85 | | | | | | | | |
| | | | a-17 | | 85 | | | | | | | |
| | | | a-18 | | | 85 | | | | | | |
| | | | a-19 | | | | 85 | | | | | |
| | | | a-20 | | | | | 85 | | | | |
| | | | a-21 | | | | | | 85 | | | |
| | | | a-22 | | | | | | | 85 | | |
| | | | a-8 | | | | | | | | 85 | |
| | | | a-9 | | | | | | | | | 85 |
| | Component (B) | Component (b1) | b1-1 | | | | | | | | | |
| | | | b1-2 | | | | | | | | | |
| | | | b1-3 | | | | | | | | | |
| | | | b1-4 | | | | | | | | | |
| | | Component (b1') | b1'-1 | | | | | | | | | |
| | | | b1'-2 | | | | 15 | 15 | 15 | 15 | 15 | 15 |
| | Total | | | 85 | 85 | 85 | 100 | 100 | 100 | 100 | 100 | 100 |
| Content of fine powder (% by mass) | | | | 100 | 100 | 100 | 20 | 20 | 30 | 30 | 40 | 40 |
| Solidification index | | | | 82 | 62 | 44 | 11 | 7 | 15 | 9 | 17 | 10 |

From the results shown in Tables 6 to 10, it can be confirmed that the coated α-SF salt particle groups of Examples 1 to 33 to which the present invention is applied have excellent solidification inhibitory properties.

Through the comparison between Examples 1 to 12 and Comparative Examples 1 to 7, it can be confirmed that the use of the component (b1), having a mean particle size within a specific range, as the component (B) can improve the solidification inhibitory properties.

From the Examples 13 to 24 and Reference Examples 1 and 2, it can be confirmed that, if the component (B) contains the component (b2), the solidification inhibitory properties can be improved. Although Examples 23 and 24 are coated α-SF salt particle groups using the component (A) having a degree of crystallinity of less than 50%, the solidification inhibitory properties there are excellent.

From Examples 25 to 33 and Reference Examples 3 to 11, it can be confirmed that the coated α-SF salt particle group in which the content of the fatty acid methyl ester in the component (A) is 0.9% to 4.0% by mass has excellent solidification inhibitory properties. Furthermore, it can be confirmed that, if the content of the fatty acid methyl ester is high within the aforementioned range of the content, the solidification inhibitory properties are excellent. In addition, it can be confirmed that, in the coated α-SF salt particle group using the component (A) having a degree of crystallinity of less than 50%, the effect of improving the solidification inhibitory properties can be more reliably exhibited.

In contrast, in the coated α-SF salt particle group (Comparative Example 1) using the component (b1'-1) instead of the component (b1), the component (b1'-1) itself was aggregated, the effect of the particle size could not be obtained, and the solidification inhibitory properties were not obtained. As is evident from the comparison between Comparative Examples 2 to 6 and, for example, Example 2, Comparative Example 2, Example 3, Comparative Example 3, and the like coated with the same component (A), all of the coated α-SF salt particle groups (Comparative Examples 2 to 6) using the component (b1'-2) instead of the component (b1) were poorer in terms of the solidification inhibitory properties than the coated α-SF salt particle group to which the present invention was applied.

From the above results, it could be confirmed that the coated α-SF salt particle group to which the present invention is applied has excellent solidification inhibitory properties.

INDUSTRIAL APPLICABILITY

The coated α-SF salt particle group to which the present invention is applied can be used in a powder detergent and the like.

The invention claimed is:

1. A coated α-sulfofatty acid alkyl ester salt particle group comprising:

α-sulfofatty acid alkyl ester salt particles (A); and a zeolite particle group-containing coating component (B) with which the particles (A) are coated, wherein the zeolite particle group is a zeolite particle group (b1) having a mean particle size of equal to or greater than 0.8 μm and less than 3.8 μm, a content of particles having a particle size of equal to or less than 355 μm in the coated α-sulfofatty acid alkyl ester salt particle group is equal to or greater than 20% by mass, a content of the particles (A) with respect to the total mass of the coated α-sulfofatty acid alkyl ester salt particle group is 70% to 99% by mass, and a content of a fatty acid alkyl ester in the particles (A) is 0.9% to 4.0% by mass.

2. The coated α-sulfofatty acid alkyl ester salt particle group according to claim 1, wherein when the particles (A) are thermally analyzed using a differential scanning calorimeter, an observed heat absorption peak area S1 at a temperature of 50° C. to 130° C. is less than 50% of a heat absorption peak area S2 at a temperature of 0° C. to 130° C.

3. A powder detergent comprising:

the coated α-sulfofatty acid alkyl ester salt particle group according to claim 1.

4. A method for manufacturing the coated α-sulfofatty acid alkyl ester salt particle group according to claim 1 comprising:

a step of coating the α-sulfofatty acid alkyl ester salt particles (A) with the zeolite particle group-containing coating component (B), wherein the zeolite particle group is a zeolite particle group (b1) having a mean particle size of equal to or greater than 0.8 μm and less than 3.8 μm.

5. The method for manufacturing the coated α-sulfofatty acid alkyl ester salt particle group according to claim 4, wherein a content of the fatty acid alkyl ester in the particles (A) is 0.9% to 4.0% by mass.

6. The method for manufacturing the coated α-sulfofatty acid alkyl ester salt particle group according to claim 4, further comprising:

a particle (A) manufacturing step of manufacturing the particles (A), wherein the particle (A) manufacturing step includes a sulfonation treatment for causing sulfonation by bringing the fatty acid alkyl ester into contact with a sulfonation gas, and a molar ratio of the sulfonation gas to the fatty acid alkyl ester in the sulfonation treatment is 1.05 to 1.13.

* * * * *